US009126439B2

(12) United States Patent
Takahashi et al.

(10) Patent No.: US 9,126,439 B2
(45) Date of Patent: Sep. 8, 2015

(54) PRINTER

(71) Applicant: Fujitsu Component Limited, Tokyo (JP)

(72) Inventors: Kohei Takahashi, Tokyo (JP); Masahiro Kaneko, Tokyo (JP); Nobuo Yatsu, Tokyo (JP); Takuya Uchiyama, Tokyo (JP); Ying Li, Tokyo (JP); Katsuaki Koshimura, Tokyo (JP); Chuqi Liang, Tokyo (JP); Hongfei Zhang, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/300,659

(22) Filed: Jun. 10, 2014

(65) Prior Publication Data

US 2015/0054907 A1 Feb. 26, 2015

(30) Foreign Application Priority Data

Aug. 22, 2013 (JP) ..... 2013-172698

(51) Int. Cl.
*B41J 15/16* (2006.01)
*B41J 11/70* (2006.01)

(52) U.S. Cl.
CPC . *B41J 15/16* (2013.01); *B41J 11/70* (2013.01)

(58) Field of Classification Search
CPC ..... B41J 11/70; B41J 11/68; B41J 11/00; B41J 15/16
USPC ..... 347/217–220, 104
See application file for complete search history.

(56) References Cited

U.S. PATENT DOCUMENTS

2007/0028739 A1* 2/2007 Kawaguchi ..... 83/651
2012/0251215 A1* 10/2012 Tsuchiya et al. ..... 400/283

FOREIGN PATENT DOCUMENTS

JP 2007-38367 2/2007
JP 2010-99852 5/2010

* cited by examiner

*Primary Examiner* — Sarah Al Hashimi
(74) *Attorney, Agent, or Firm* — Staas & Halsey LLP

(57) ABSTRACT

Provided is a printer capable of enhancing the cutting efficiency of printing paper. A printer, includes a printing unit; a fixed blade; a movable blade provided to be movable relative to the fixed blade, and cut the printing medium with the fixed blade; and a tension mechanism applying a tensional force to the printing medium. The tension mechanism includes a receiving member disposed on the discharge side of the fixed blade; and a pressing member extending from the movable blade toward the discharge side, moving with the movable blade. The pressing member includes a pressing part configured to press the printing medium against the receiving member and move toward the discharge side while holding the printing medium between the pressing part and the receiving member, as the movable blade moves toward the fixed blade.

16 Claims, 26 Drawing Sheets

PRINTER

CROSS-REFERENCE TO RELATED APPLICATIONS

This application is based upon and claims the benefit of priority of the prior Japanese Application No. 2013-172698, filed on Aug. 22, 2013, the entire contents of which are incorporated herein by reference.

BACKGROUND OF THE INVENTION

1. Field of the Invention

The present invention relates to a printer.

2. Description of the Related Art

There is known a printer provided with a fixed blade fixed on a housing, and a movable blade mounted on the housing to be reciprocally movable relative to the fixed blade for cutting printing paper by the movable blade and the fixed blade (For example, JP2007-38367A, JP2010-099852A).

In cutting a printing paper, the cutting efficiency may be lowered when the printing paper is held between a movable blade and a fixed blade in a relaxed state.

SUMMARY OF THE INVENTION

A printer according to the present invention is for printing on a printing medium. The printer is provided with a printing unit; a fixed blade; a movable blade provided to be movable relative to the fixed blade, and configured to cut printing medium with the fixed blade, and a tension mechanism configured to apply a tensional force to the printing medium.

The tension mechanism includes a receiving member disposed on the discharge side which is a direction in which the printing medium is discharged relative to the fixed blade, for receiving the printing medium; and a pressing member extending from the movable blade toward the discharge side, and configured to move with the movable blade. The pressing member includes a pressing part configured to press the printing medium against the receiving member and move toward the discharge side while holding the printing medium between the pressing part and the receiving member, as the movable blade moves toward the fixed blade.

BRIEF DESCRIPTION OF THE DRAWINGS

The aforementioned or other objects, features, and advantages of the present invention will become more apparent by describing the following preferred embodiments with reference to the accompanying drawings in which.

DETAILED DESCRIPTION

In the following, embodiments of the invention are described in detail based on the drawings.

Figure 1:
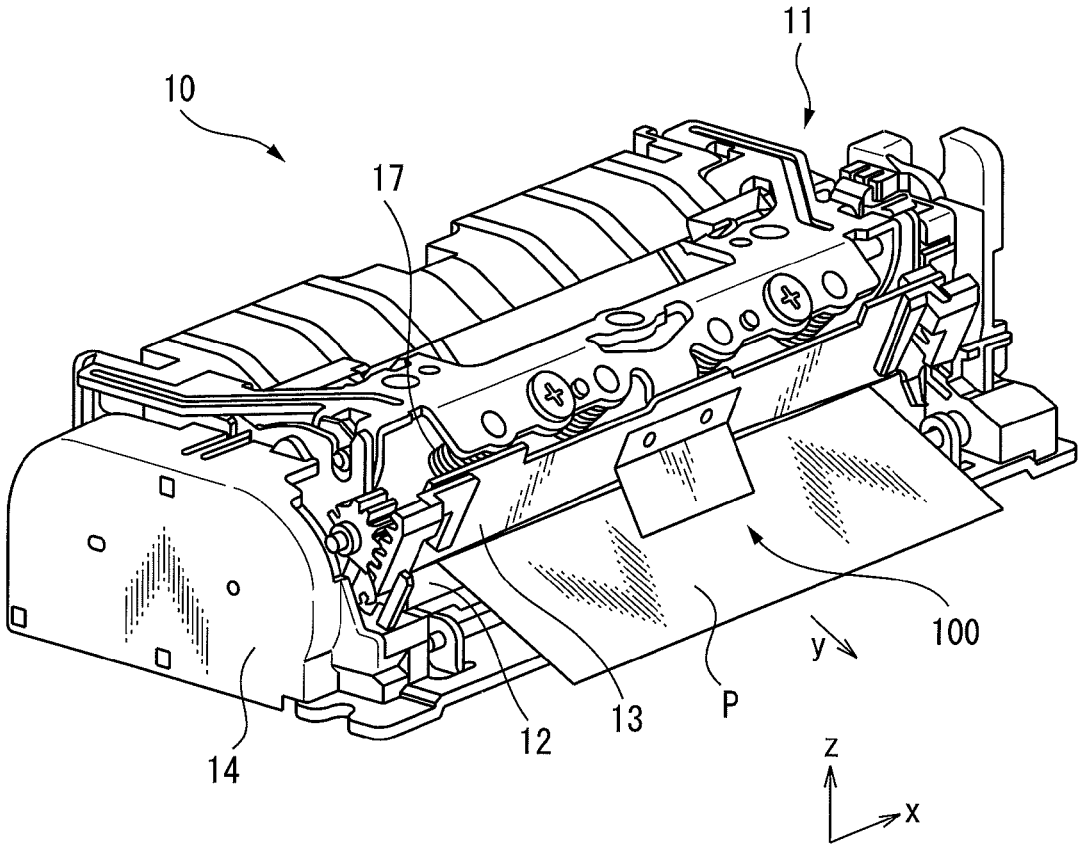
FIG. 1 is a perspective view of a printer according to an embodiment of the invention.
Figure 2:
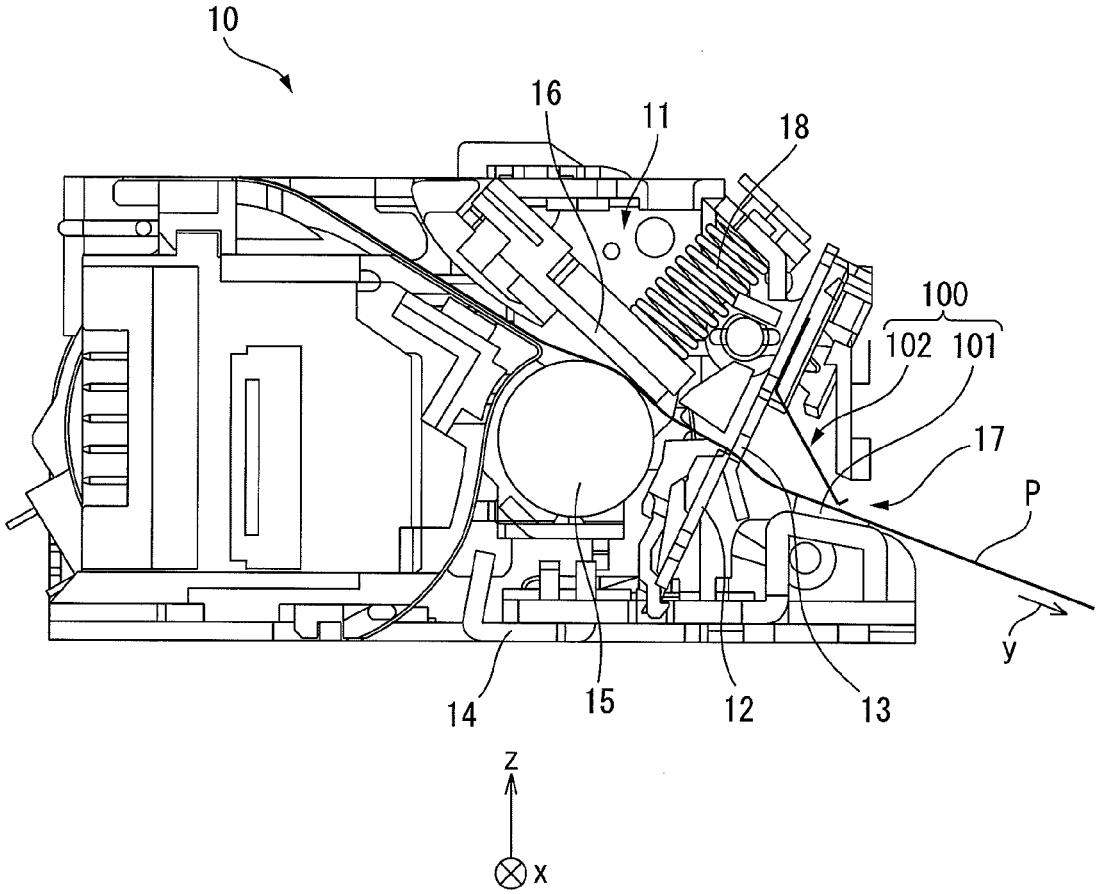
FIG. 2 is a side sectional view of the printer illustrated in FIG. 1.
Figure 3:
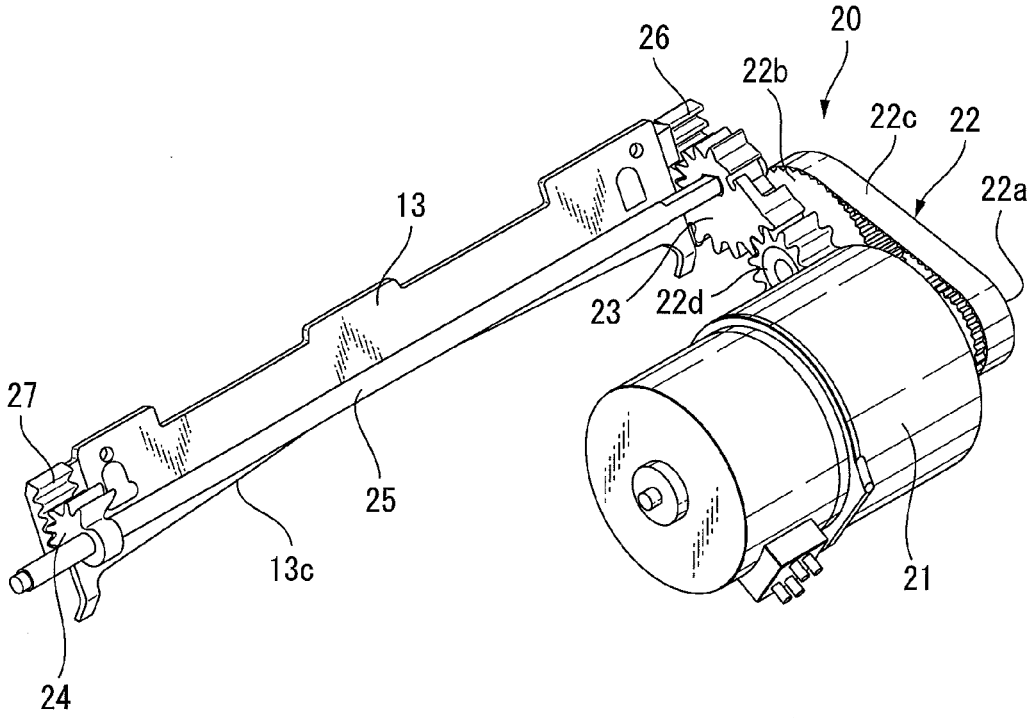
FIG. 3 is a diagram illustrating a driving mechanism of the embodiment.
Figure 4:
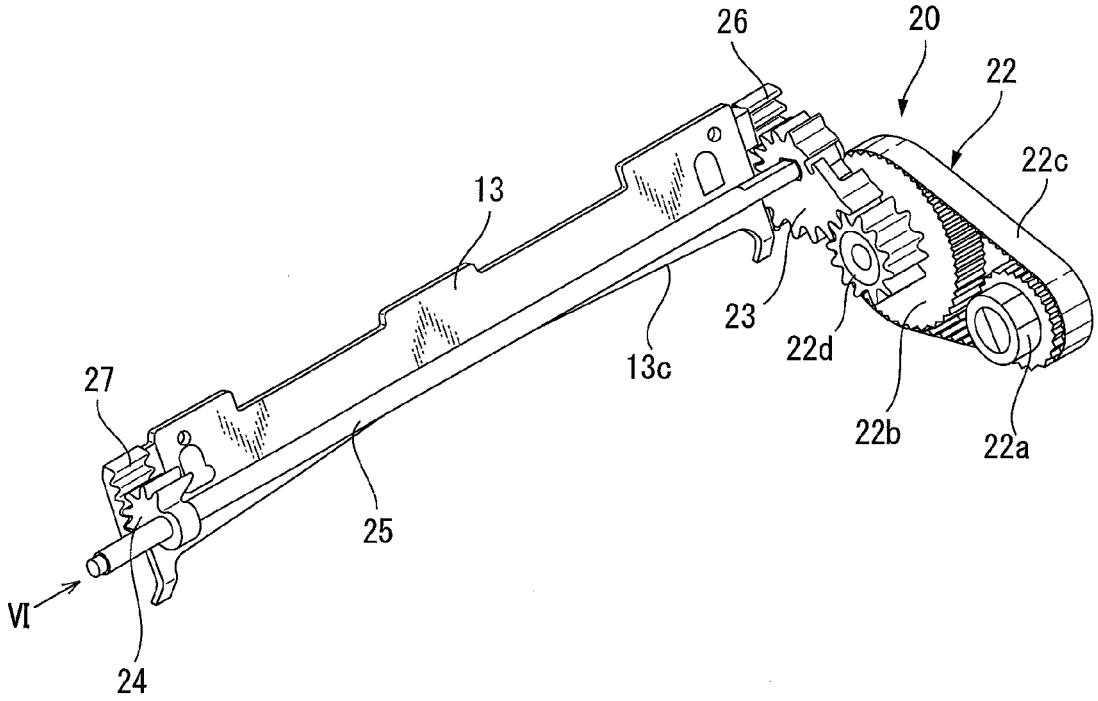
FIG. 4 is a diagram illustrating the driving mechanism of the embodiment.
Figure 5:
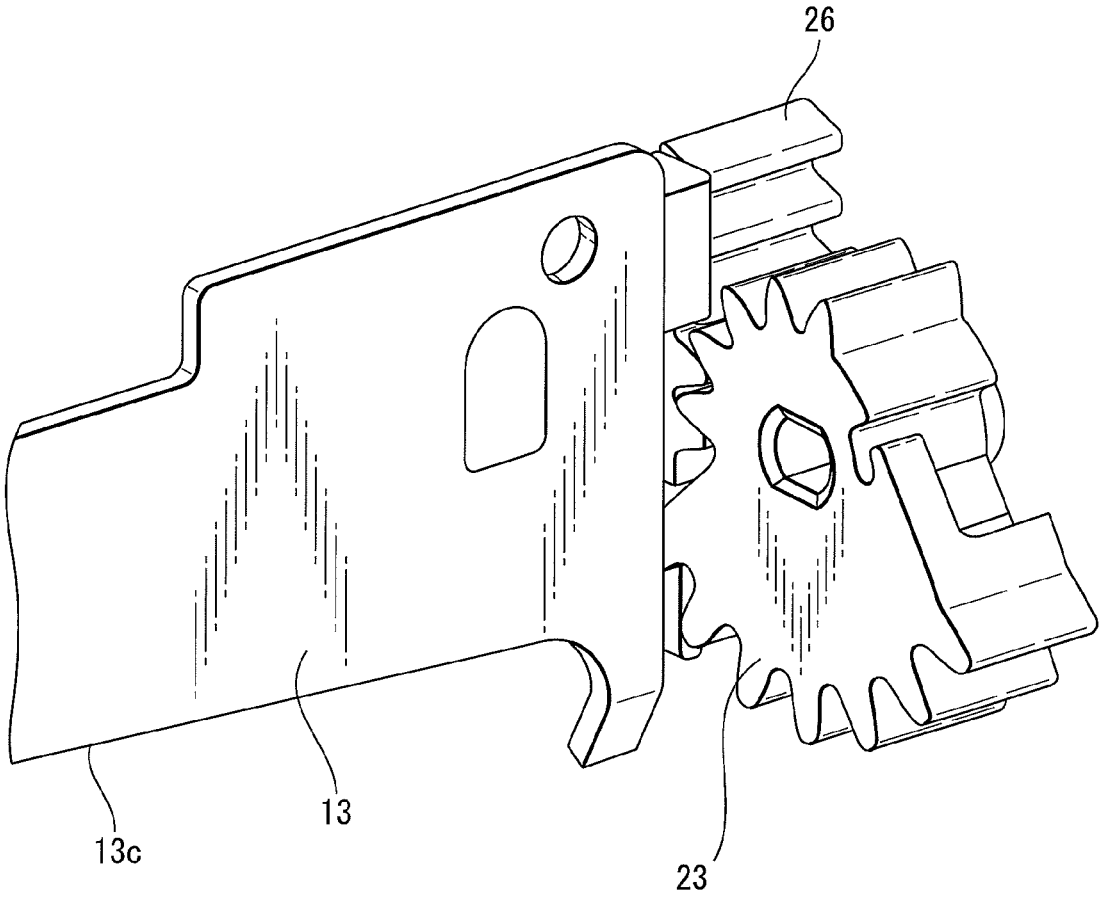
FIG. 5 is an enlarged view of the driving mechanism.
Figure 6:
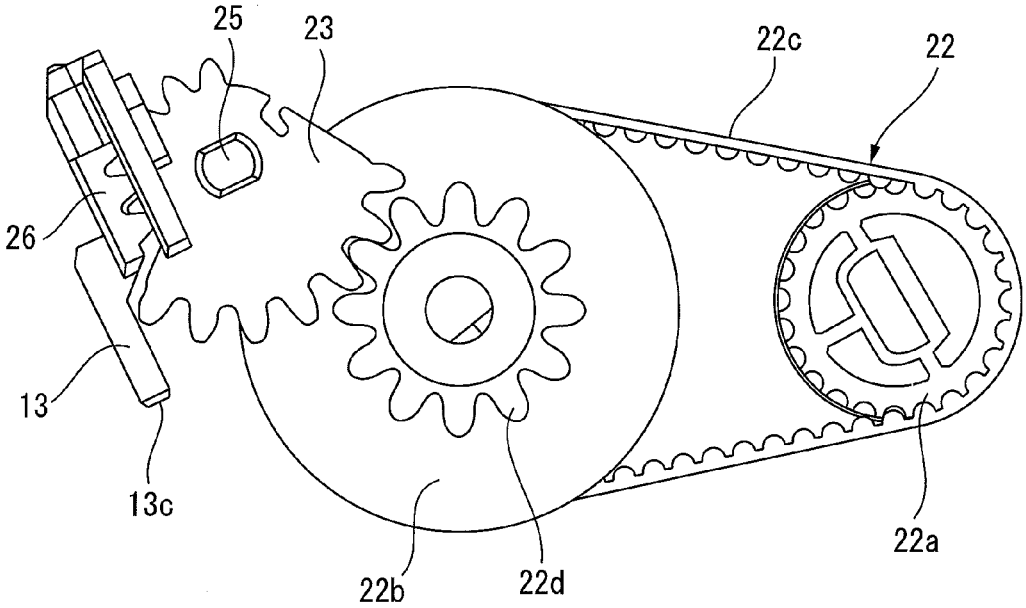
FIG. 6 is a side view of the driving mechanism when viewed from the arrow VI in FIG. 4.

A configuration of a printer 10 according to an embodiment of the invention is described referring to FIGS. 1 and 2. In this embodiment, the printer 10 is a thermal printer configured to print on printing paper P as a printing medium. As illustrated in FIGS. 1 and 2, the width direction of the printer 10 (or the width direction of printing paper) is referred to as x-axis direction, and the height direction of the printer 10 is referred to as z-axis direction. Further, in the following description, to simplify the description, the arrow direction of x-axis in the drawings is referred to as a right direction, and the arrow direction of z-axis in the drawings is referred to as an upward direction.

The printer 10 is provided with a housing 14; a printing unit 11 configured to print on a printing paper P; and a fixed blade 12 and a movable blade 13 configured to cut the printing paper P. The printing unit 11 has a platen 15 disposed in the housing 14 and configured to be rotatable in the housing 14, and a head 16.

The printing paper P is fed from a paper feeding unit (not illustrated) disposed on the feed side of the printing unit 11 toward a paper discharge port 17 of the printer 10 in the direction indicated by the arrow y. In the specification, the upstream side of the printing paper P being fed is referred to as the feed side, and the downstream side thereof is referred to as the discharge side. The platen 15 is rotatably mounted in the housing 14 in such a manner as to come into contact with the lower surface of the printing paper P as illustrated in the drawings.

The head 16 is disposed to face the platen 15, and is disposed in the housing 14 in such a manner as to come into contact with the upper surface of the printing paper P as illustrated in the drawings. The head 16 is urged toward the platen 15 by a spring 18 for holding the printing paper P between the head 16 and the platen 15. The head 16 includes a heating unit to perform thermal printing on the printing paper P by applying heat to the printing paper P.

The fixed blade 12 is fixed in the housing 14 on the discharge side of the printing unit 11 in such a manner that a blade part of the fixed blade 12 is directed upward. The movable blade 13 is disposed on the upper side of the fixed blade 12 in such a manner that a blade part of the movable blade 13 is directed downward. The movable blade 13 is mounted in the housing 14 to be reciprocally movable in the direction toward the fixed blade 12 and in the direction away from the fixed blade 12. The movable blade 13 cuts the printing paper P in cooperation with the fixed blade 12.

Next, the driving mechanism 20 for driving the movable blade 13 in the embodiment is described referring to FIGS. 3 to 6. The driving mechanism 20 includes a motor 21, a pulley 22 that transmits a rotary movement of a rotary shaft (not illustrated) of the motor 21, and a first driving gear 23 and a second driving gear 24 that transmit the rotary movement of the motor 21 via the pulley 22. The motor 21 is fixed in the housing 14, and rotates the rotary shaft.

The pulley 22 includes a first gear 22*a*, a second gear 22*b*, and a belt 22*c* installed in mesh with the first gear 22*a* and the second gear 22*b*. The first gear 22*a* is fixed on the rotary shaft of the motor 21, and the rotary movement of the motor 21 is transmitted to the second gear 22*b* via the first gear 22*a* and the belt 22*c*.

A small gear 22*d* is coaxially mounted on the second gear 22*b*. The first driving gear 23 meshes with the small gear 22*d* on its one side, and meshes with a tooth 26 fixed on one end of the movable blade 13 on the other side. The second driving gear 24 is mechanically linked to the first driving gear 23 via a shaft 25. The second driving gear 24 meshes with a tooth 27 fixed on an end of the movable blade 13 on a side opposite to the side where the tooth 26 is provided.

As the first driving gear 23 is rotated by receiving a rotational force from the small gear 22*d*, the second driving gear 24 is integrally rotated with the first driving gear 23 via the shaft 25. The rotations of the first driving gear 23 and the second driving gear 24 are converted into up-and-down movement of the movable blade 13 via the tooth 26 and the tooth 27. In this way, the driving mechanism 20 moves the movable blade 13 in up-and-down directions. In the embodiment, the movable blade 13 includes a concave-shaped blade 13*c* configured so that the height of the movable blade 13 in up-and-down directions decreases as the movable blade 13 extends from both ends thereof toward the middle thereof in the width direction.

Figure 7:
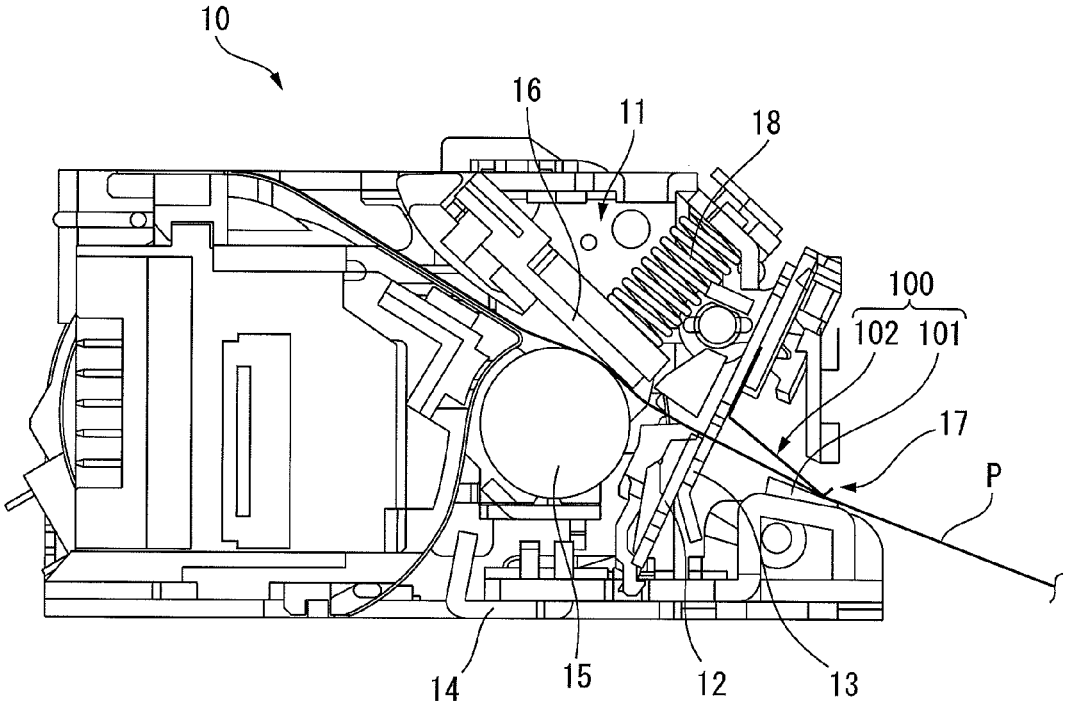
FIG. 7 is a diagram illustrating a state after printing paper has been cut.

Referring to FIGS. 1 and 7, the printer 10 according to the embodiment is provided with a tension mechanism 100 configured to apply a tensional force to the printing paper P when cutting the printing paper P. The tension mechanism 100 pulls the printing paper P toward the discharge side in association with the movable blade 13 when the movable blade 13 is moving toward the fixed blade 12 so as to cut the printing paper P. FIG. 7 illustrates a state where the printing paper P is cut while the tension mechanism 100 pulls the printing paper P toward the discharge side.

Figure 8A:
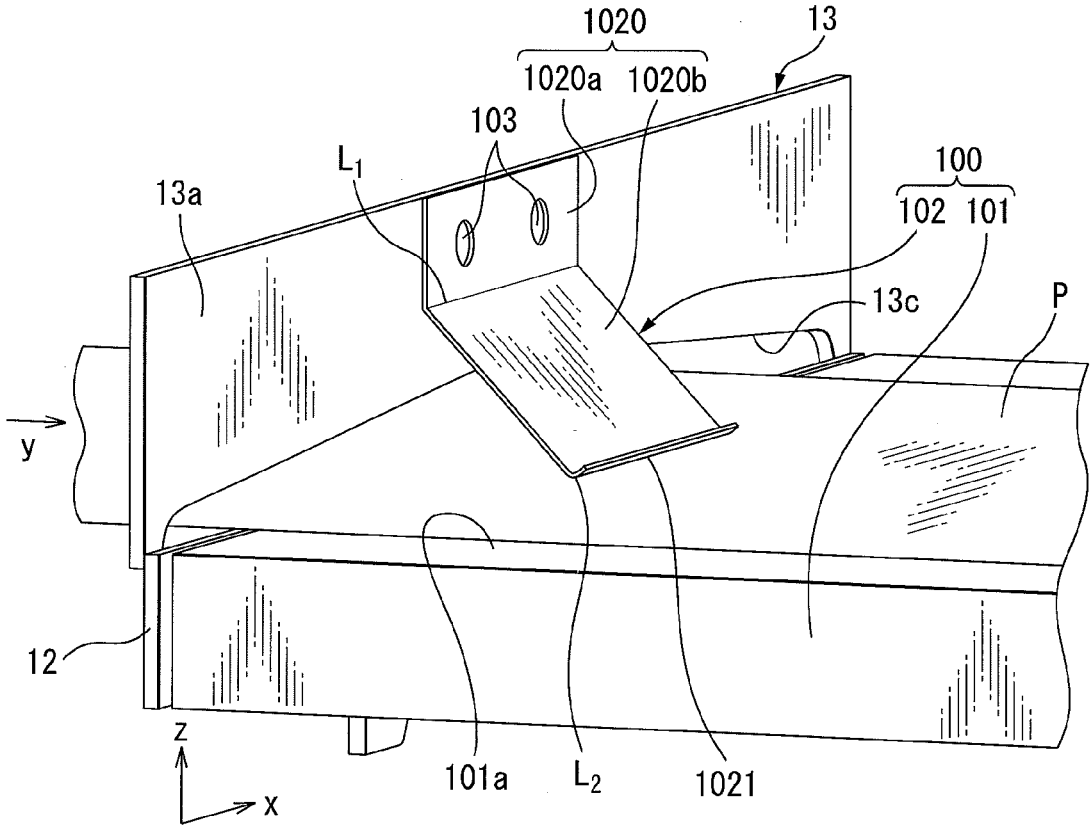
FIGS. 8A and 8B are schematic diagrams of a tension mechanism according to an embodiment of the invention.
Figure 8B:
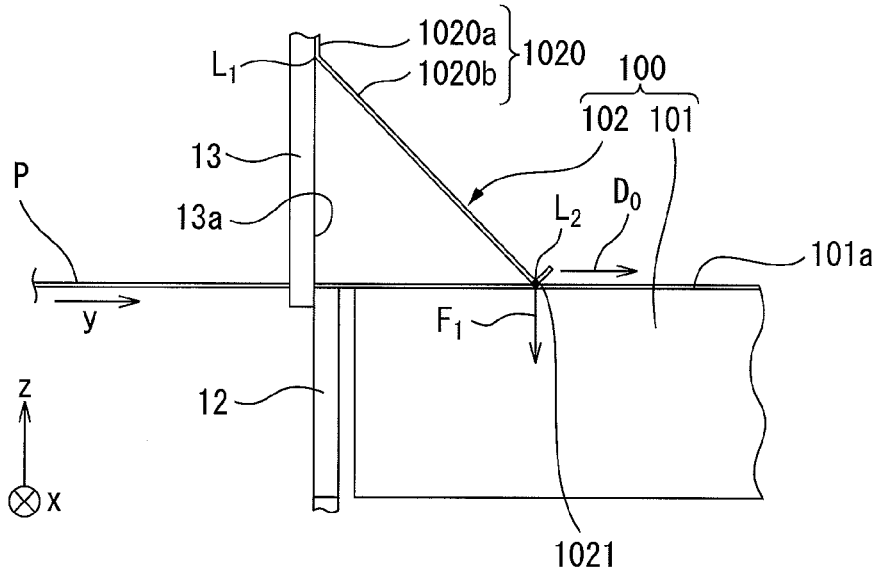

A configuration of the tension mechanism 100 in the first embodiment is described referring to FIGS. 8A and 8B. To simplify the understanding, the fixed blade 12, the movable blade 13, and the tension mechanism 100 are schematically illustrated in FIGS. 8A and 8B. The tension mechanism 100 is provided with a receiving member 101 disposed on the discharge side of the fixed blade 12, and a pressing member 102 mounted on the movable blade 13 and extending from the movable blade 13 toward the discharge side.

As illustrated in FIGS. 2 and 7, the receiving member 101 is fixedly mounted on the housing 14 at a position of the paper discharge port 17 of the housing 14. As illustrated in FIGS. 8A and 8B, the receiving member 101 is a stage having a flat upper surface 101*a*, and is configured to support the printing paper P on the upper surface 101*a*.

As will be described later, the pressing member 102 is configured to move with the movable blade 13 and hold the printing paper P with the receiving member 101. The pressing member 102 includes an arm 1020 extending from a surface 13*a* of the movable blade 13 on the discharge side toward the discharge side and toward the lower side, and a pressing part 1021 formed at a tip of the arm 1020 on the discharge side.

The arm 1020 includes a first part 1020*a* fixed on the surface 13*a* of the movable blade 13, and a second part 1020*b* extending from the lower end of the first part 1020*a*. The first part 1020*a* of the arm 1020 is fixed on the surface 13*a* by a fixing tool 103. The pressing part 1021 is formed at a tip of the second part 1020*b* on the discharge side so as to face the printing paper P and be bent into an L-shape.

In this embodiment, the pressing member 102 is constituted of a flat resilient member. The first part 1020*a* and the second part 1020*b* of the arm 1020 are defined by bending the resilient member along a bending line $L_1$. Further, the pressing part 1021 is formed by bending a tip of the second part 1020*b* on the discharge side along a bending line $L_2$.

Next, a function of the tension mechanism 100 in the embodiment is described referring to FIGS. 8A and 8B, and FIGS. 9A and 9B. When cutting the printing paper P, the driving mechanism 20 moves the movable blade 13 downward toward the fixed blade 12. Then, the movable blade 13 comes into contact with the upper surface of the printing paper P. On the other hand, the pressing part 1021 of the tension mechanism 100 comes into contact with the printing paper P before the movable blade 13 and the fixed blade 12 cut the printing paper P (e.g. before the movable blade 13 comes into contact with the printing paper P).

Figure 9A:
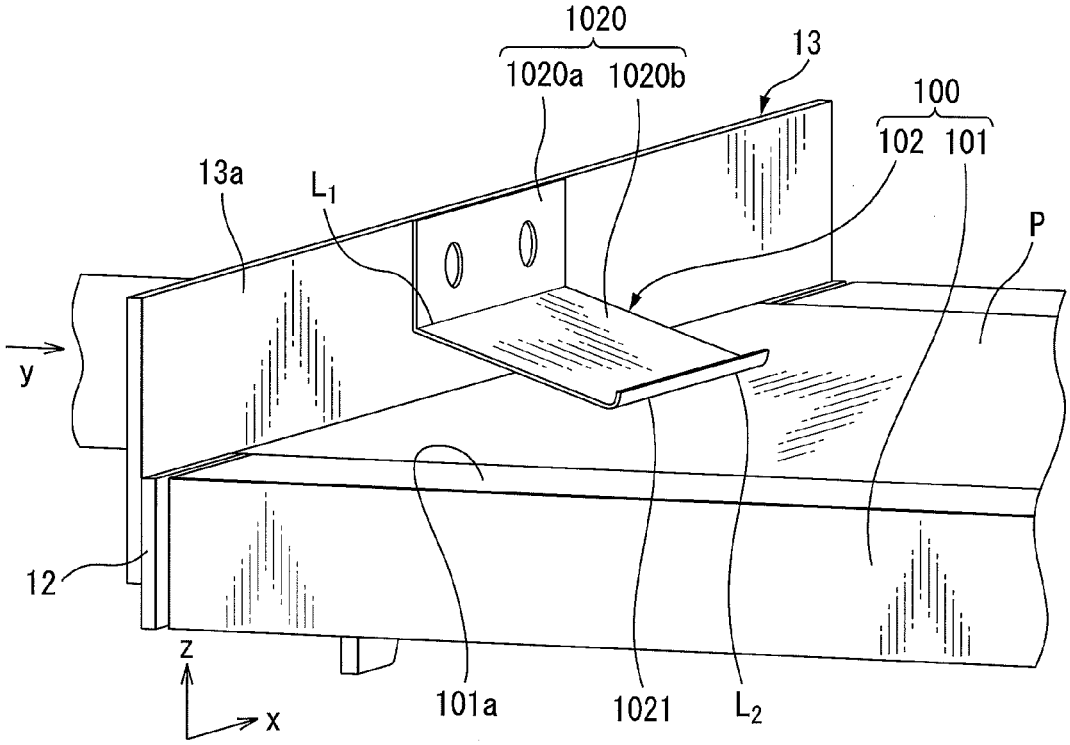
FIGS. 9A and 9B are diagrams illustrating a state that the movable blade is moved toward a fixed blade.
Figure 9B:
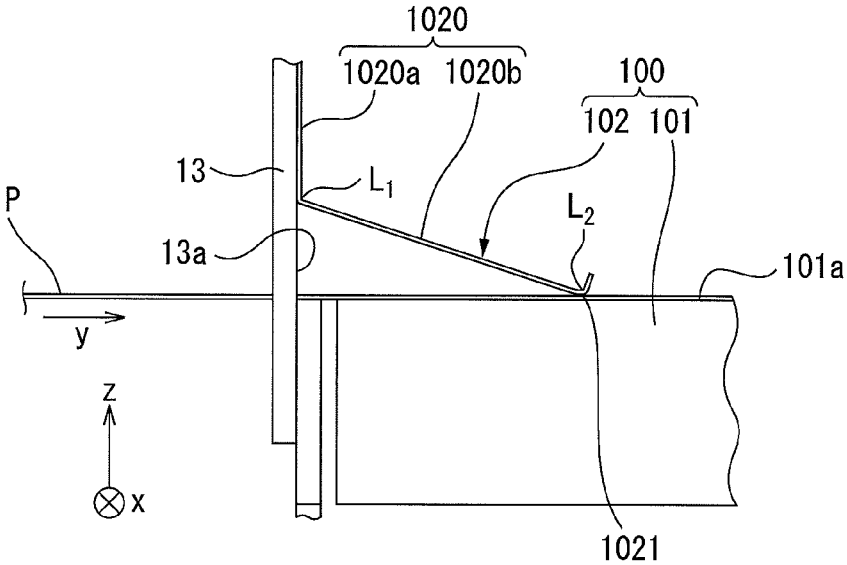

When cutting the printing paper P, the movable blade 13 is moved further downward from the state illustrated in FIGS. 8A and 8B to the state illustrated in FIGS. 9A and 9B. As the movable blade 13 is moved downward, the pressing part 1021 presses the printing paper P against the upper surface 101*a* of the receiving member 101, and is moved toward the discharge side as illustrated by the arrow $D_0$ in FIG. 8B while holding the printing paper P between the pressing part 1021 and the receiving member 101. The state illustrated in FIGS. 9A and 9B corresponds to the state illustrated in FIG. 7.

As the pressing part 1021 is moved toward the discharge side as described above, the arm 1020 is bent along the bending line $L_1$ in such a manner that the angle between the first part 1020*a* and the second part 1020*b* decreases, and the second part 1020*b* is bent. In this way, the arm 1020 is resiliently deformed in response to downward movement of the movable blade 13 after the pressing part 1021 comes into contact with the printing paper P. The resiliently deformed arm 1020 causes the pressing part 1021 to press against the printing paper P by a restoring force of the arm 1020.

Thus, the arm 1020 functions as a plate spring capable of generating a resilient force by being resiliently deformed in response to downward movement of the movable blade 13. As illustrated in FIGS. 8A and 8B, the pressing part 1021 is moved toward the discharge side while pressing the printing paper P against the receiving member 101 by a pressing force $F_1$ which is a force component acting in a direction perpendicular to the upper surface 101*a* of the receiving member 101.

By the aforementioned operation, the tension mechanism 100 in the embodiment can hold the printing paper P between the receiving member 101 and the pressing member 102 and pull the printing paper P toward the discharge side, when cutting the printing paper P. Therefore, it is possible to cut the printing paper P by the movable blade 13 and the fixed blade 12 in a state where the printing paper P is strained. This is advantageous in enhancing the cutting efficiency of printing paper P.

Further, according to the embodiment, it is possible to apply a tensional force to the printing paper P by the pressing member 102 of a simplified structure and constituted of one resilient member, without using a large device for applying a tensional force to the printing paper P. This is advantageous in enhancing the cutting efficiency of printing paper P, with saving the production cost.

A tension mechanism 200 according to a second embodiment of the invention is described referring to FIGS. 10A to 13B. Substantially the same elements as those in the first embodiment are indicated with the same numerals, and a detailed description thereof is omitted herein.

Figure 10A:
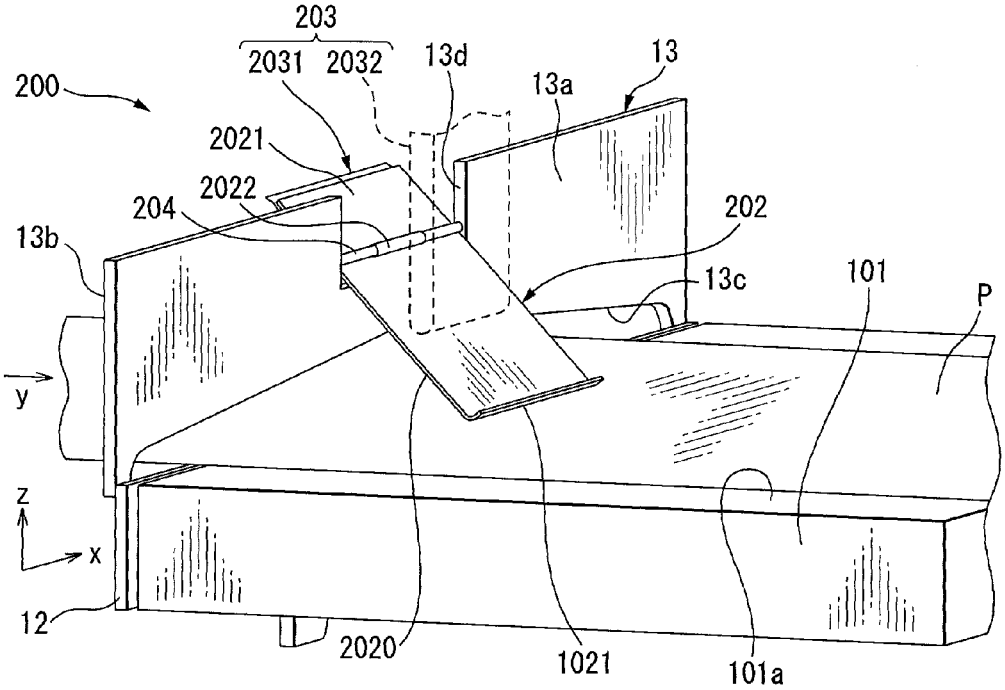
FIGS. 10A and 10B are schematic diagrams of a tension mechanism according to another embodiment of the invention.
Figure 10B:
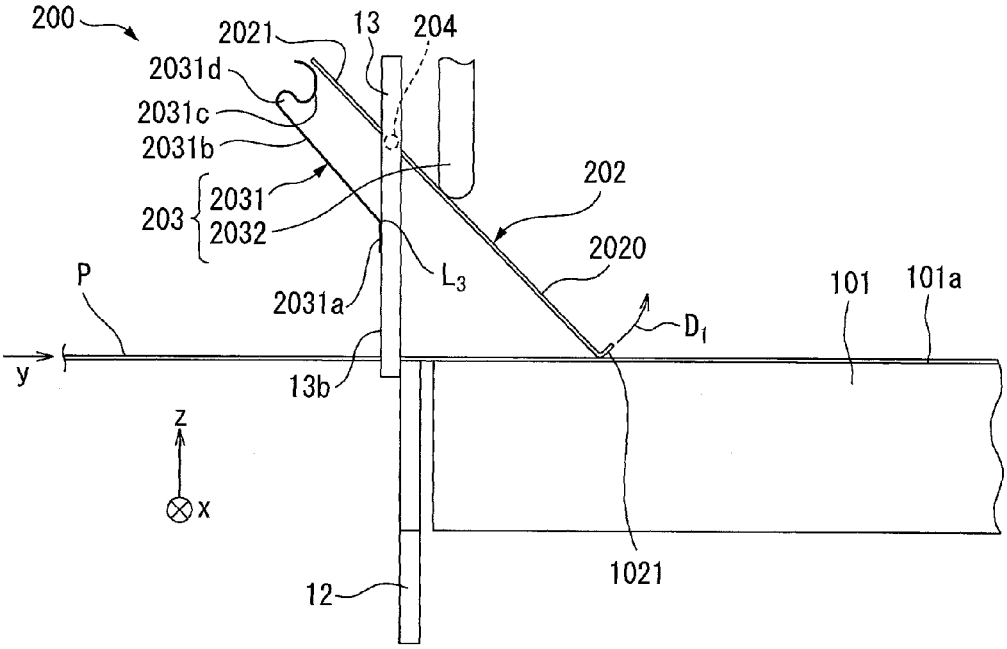

A configuration of the tension mechanism 200 of the second embodiment is described referring to FIGS. 10A and 10B. The tension mechanism 200 is provided with a receiving member 101; a pressing member 202 pivotally attached to the movable blade 13; and a restricting unit 203 configured to restrict pivotal movement of the pressing member 202.

The pressing member 202 has an arm 2020 pivotally supported on the movable blade 13 by a shaft 204 and extending from the movable blade 13 toward the discharge side and toward the lower side; and a pressing part 1021 formed at a tip of the arm 2020 on the discharge side. The arm 2020 includes an extension portion 2021 extending toward the feed side relative to the movable blade 13. A hollow holding part 2022 for holding the shaft 204 extending along x-axis is formed between the arm 2020 and the extension portion 2021.

The shaft 204 is fixed on the movable blade 13 in such a manner as to extend along x-axis within an opening 13*d* formed in the middle part of the movable blade 13, and is inserted through the holding part 2022. Thus, the pressing member 202 is pivotally supported on the movable blade 13 via the shaft 204 so as to rotate around x-axis. As well as the first embodiment, the pressing member 202 is constituted of a flat resilient member. A pressing part 1021 comes into contact with printing paper P is formed by bending a tip of the arm 2020 into an L-shape.

The restricting unit 203 includes a first restricting part 2031 extending from the movable blade 13 toward the feed side, and a second restricting part (an example of a return part) 2032 that comes into contact with the arm 2020 on the discharge side of the movable blade 13. To simplify the understanding, in FIG. 10A and FIG. 13A, the second restricting part 2032 is indicated by the dotted line, and in FIG. 11A and FIG. 12A, the illustration of the second restricting part 2032 is omitted.

The first restricting part 2031 includes a first part 2031*a* fixed on a surface 13*b* of the movable blade 13 on the feed side, a second part 2031*b* extending from the upper end of the first part 2031*a* toward the feed side and toward the upper side, and a convex part 2031*c* formed at a tip of the second part 2031*b* on the feed side. The first restricting part 2031 has substantially the same width as the pressing member 202, and is constituted of a flat resilient member.

The first part 2031*a* and the second part 2031*b* are defined by bending one resilient member constituting the first restricting part 2031 along a bending line $L_3$. The convex part 2031*c* of the first restricting part 2031 is formed by bending a tip of the second part 2031*b* on the feed side into such a U-shape as to be convex toward the discharge side when viewed from x-axis direction. Further, a concave part 2031*d* to be concave toward the feed side when viewed from x-axis direction is formed between the second part 2031*b* and the convex part 2031*c*.

On the other hand, the second restricting part 2032 of the restricting unit 203 is mounted in the housing 14 of a printer 10, and extends from the housing 14 downward to a position upwardly spaced from the fixed blade 12 by a predetermined distance. The second restricting part 2032 comes into contact with the arm 2020 at a predetermined height position, as will be described later.

A function of the tension mechanism 200 in the embodiment is described referring to FIG. 10A to FIG. 13B. As illustrated in FIGS. 10A and 10B, the extension portion 2021 of the arm 2020 is disposed at a position above the convex part 2031*c* of the first restricting part 2031 before the printing paper P is cut. When cutting the printing paper P, the movable blade 13 is moved downward toward the fixed blade 12 from the state illustrated in FIGS. 10A and 10B to the state illustrated in FIGS. 11A and 11B.

As the movable blade 13 is moved downward, the pressing part 1021 holds the printing paper P between the pressing part 1021 and the receiving member 101, and presses the printing paper P against the upper surface 101*a* of the receiving member 101. Then, the pressing part 1021 receives, from the receiving member 101, force acting in a direction opposite to the direction of force of pressing the printing paper P against the receiving member 101. Due to this force, the arm 2020 is urged to pivot relative to the movable blade 13 in a first direction $D_1$ (see FIG. 10B) around the shaft 204, in other words, in such a direction that the pressing part 1021 is released from the printing paper P.

On the other hand, the pivotal movement of the arm 2020 in the first direction $D_1$ is restricted, because the extension portion 2021 of the arm 2020 is in contact with the convex part 2031*c* of the first restricting part 2031 at the upper part of the convex part 2031*c*. According to this configuration, as the movable blade 13 is moved downward, the pressing part 1021 can press the printing paper P against the upper surface 101*a* of the receiving member 101, and is moved toward the discharge side while holding the printing paper P between the pressing part 1021 and the receiving member 101.

Figure 11A:
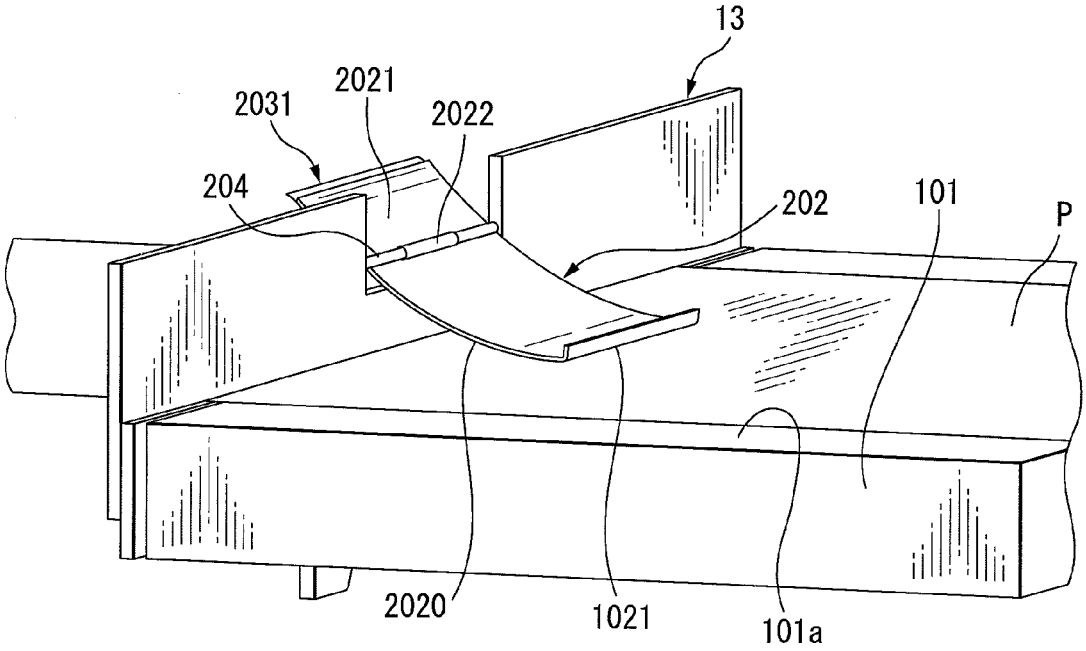
FIGS. 11A and 11B are diagrams illustrating a state that the movable blade is moved toward the fixed blade.
Figure 11B:
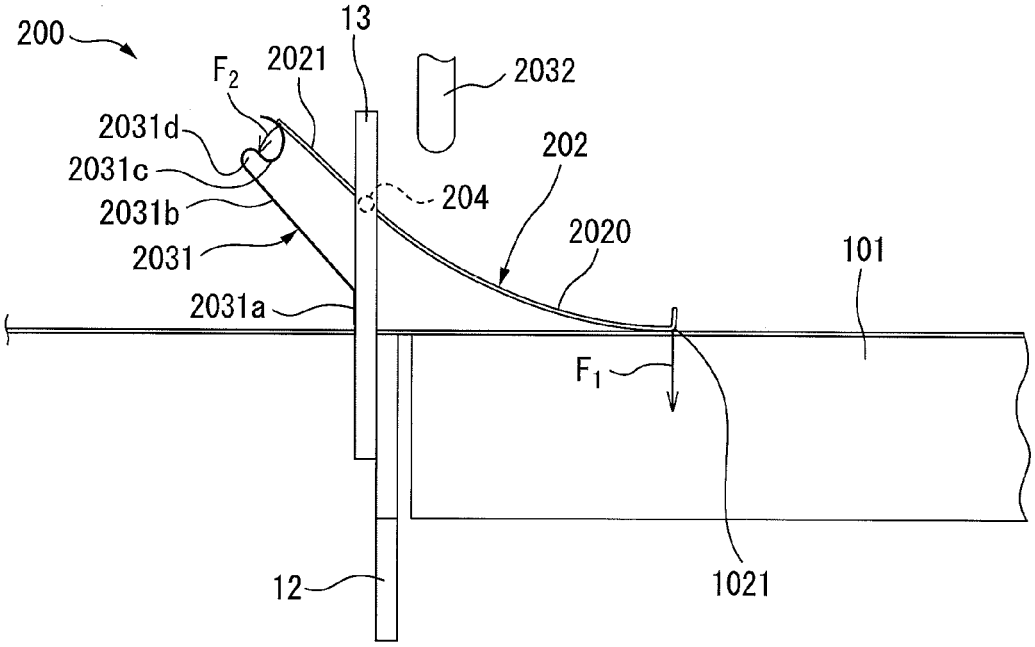

Further, as illustrated in FIGS. 11A and 11B, as the movable blade 13 is moved further downward, the arm 2020 in contact with the upper surface 101*a* via the printing paper P is resiliently deformed into a curved shape. The arm 2020 presses the pressing part 1021 against the receiving member 101 in response to resilient deformation of the arm 2020. In this way, the pressing part 1021 is moved toward the discharge side, while pressing the printing paper P against the receiving member 101 with the pressing force $F_1$, by the action of the first restricting part 2031 and the arm 2020.

By such an operation, the tension mechanism 200 can hold the printing paper P between the receiving member 101 and the pressing member 202, and pull the printing paper P toward the discharge side when cutting the printing paper P. As a result, it is possible to cut the printing paper P by the movable blade 13 and the fixed blade 12 in a state where the printing paper P is strained. This is advantageous in enhancing the cutting efficiency of printing paper P.

On the other hand, as the movable blade 13 is moved downward as illustrated in FIG. 11B, the extension portion 2021 of the arm 2020 presses the upper part of the convex part 2031*c* of the first restricting part 2031 with a force $F_2$. Upon receiving the force $F_2$, the first restricting part 2031 is gradually deformed resiliently, and the position of the convex part 2031*c* is gradually displaced toward the feed side.

When the movable blade 13 is moved further downward after cutting the printing paper P, and crosses over a predetermined first position, the extension portion 2021 climbs over the convex part 2031*c*, and the engagement between the extension portion 2021 and the convex part 2031*c* is released. As a result, the arm 2020 is pivotally moved slightly in the first direction $D_1$, and then the extension portion 2021 is accommodated in the concave part 2031*d* formed between the second part 2031*b* and the convex part 2031*c*. This state is illustrated in FIG. 12B. As illustrated in FIG. 12C, the pressing part 1021 of the pressing member 202 is released from the printing paper P by pivotal movement of the arm 2020 in the first direction $D_1$.

Figure 12A:
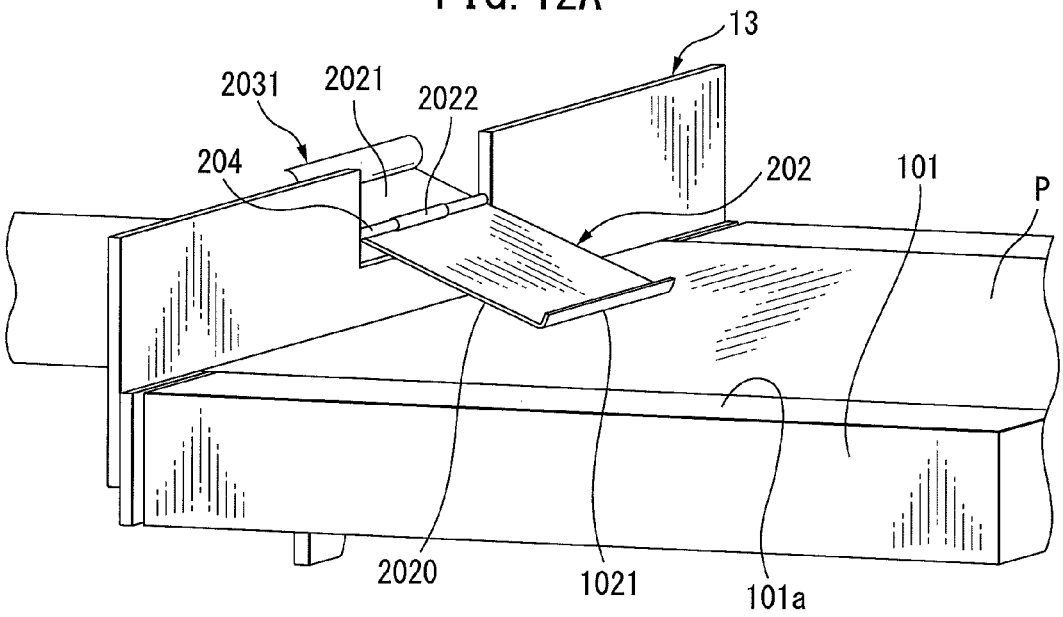
FIGS. 12A to 12C are diagrams illustrating a state that the movable blade moves toward the fixed blade.
Figure 12C:
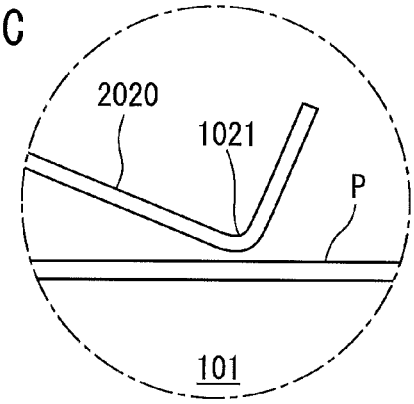
Figure 12B:
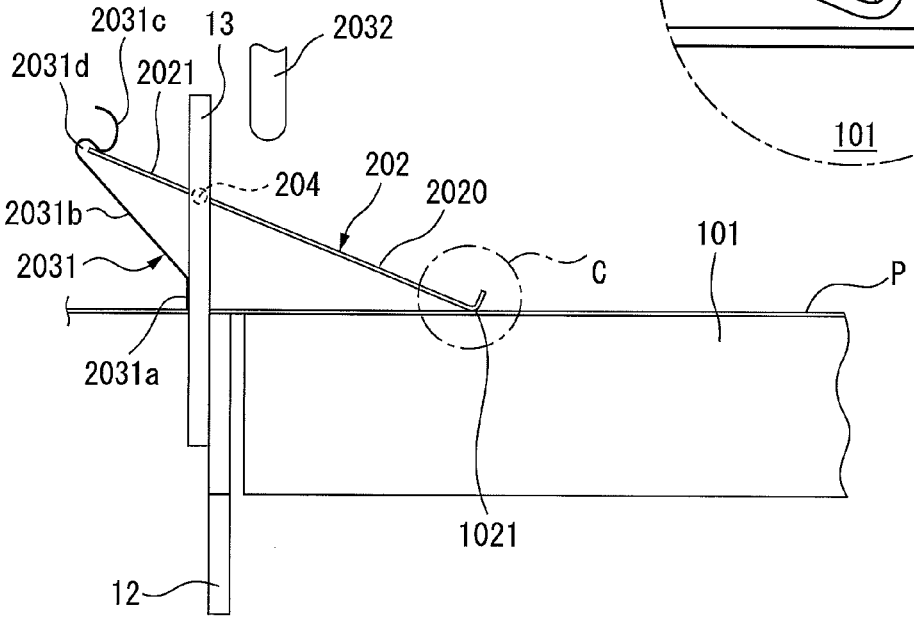
Figure 13A:
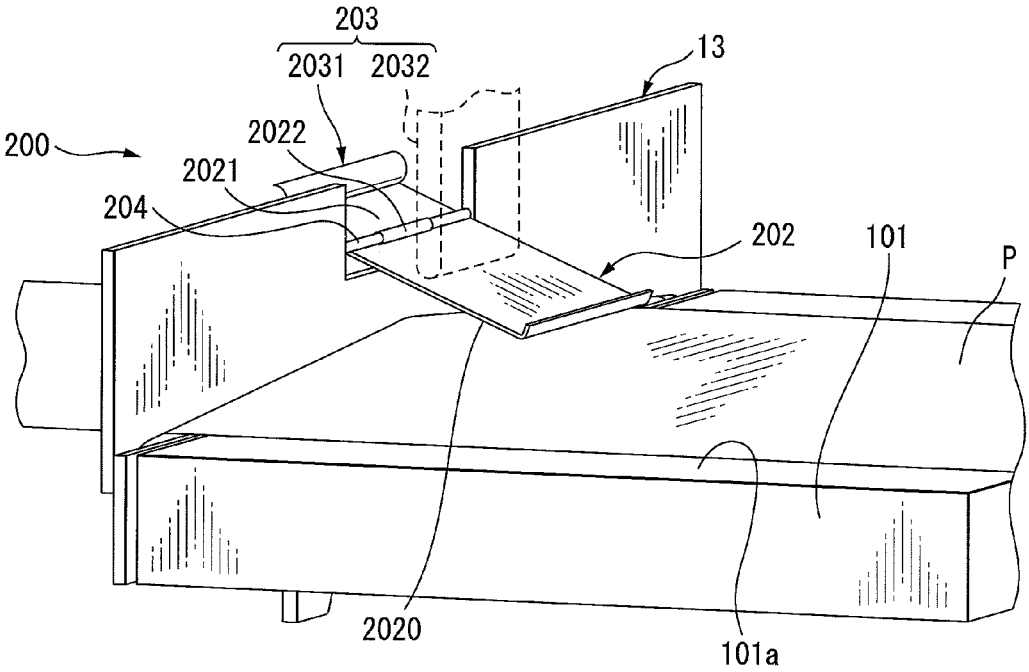
FIGS. 13A and 13B are diagrams illustrating a state that the movable blade is moved away from the fixed blade.
Figure 13B:
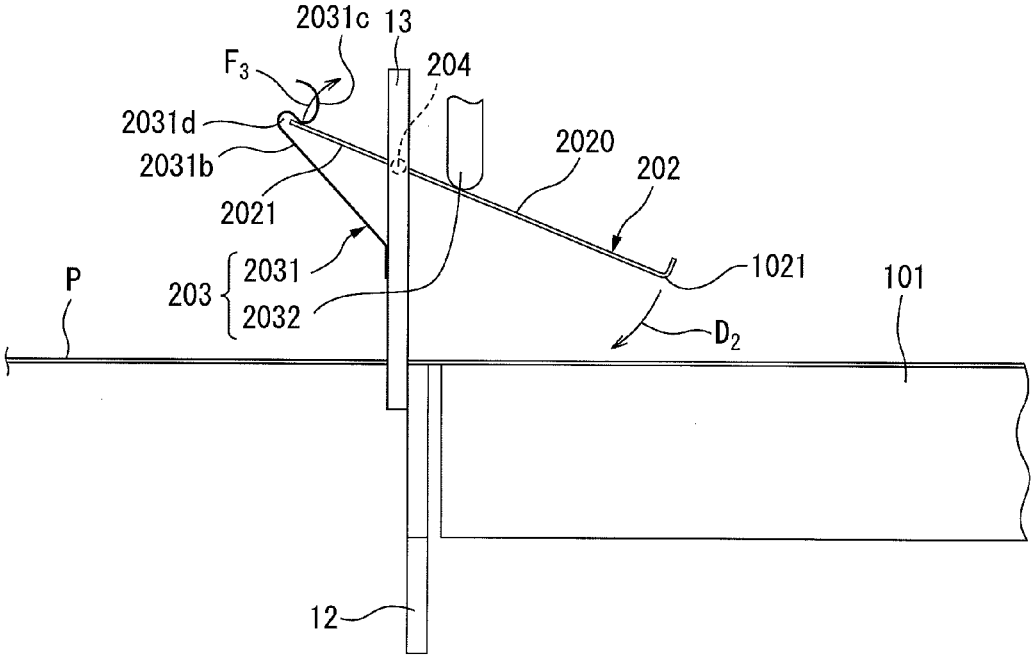
Figure 14A:
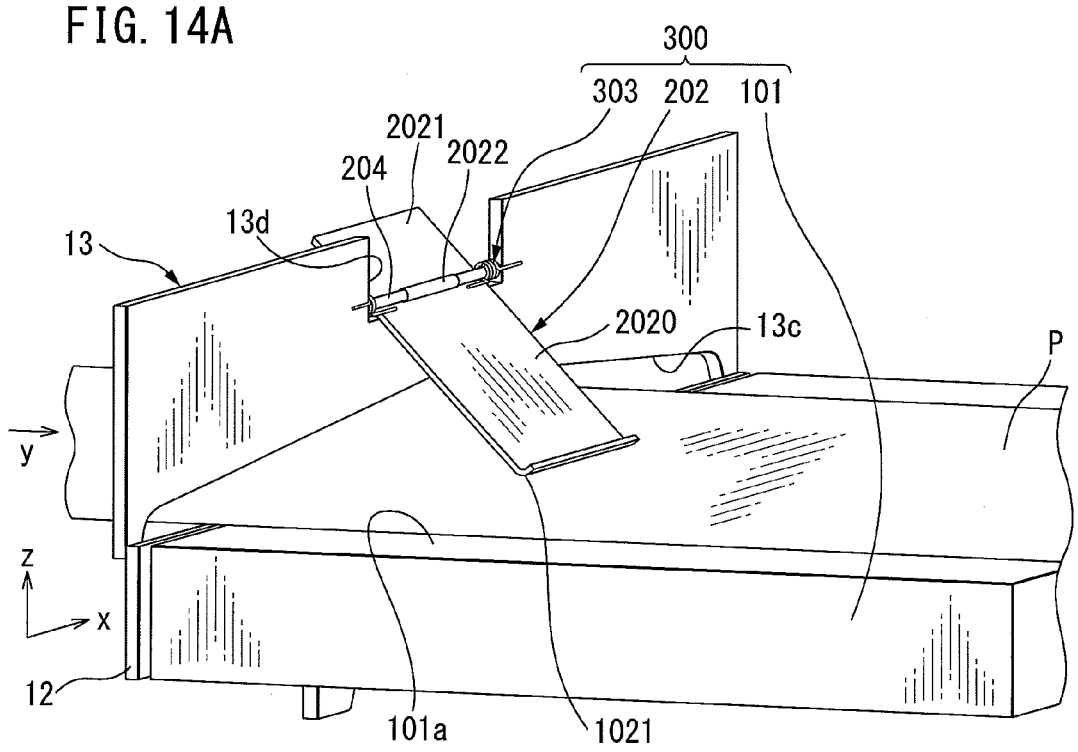
FIGS. 14A and 14B are schematic diagrams of a tension mechanism according to another embodiment of the invention.
Figure 14B:
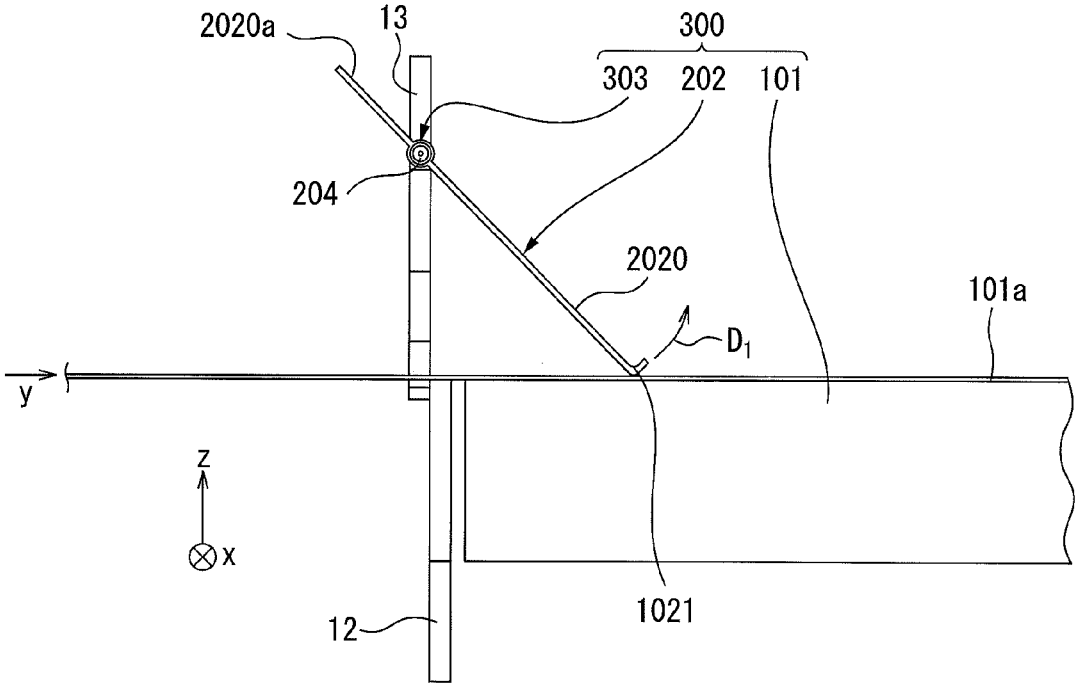

After finishing the cutting operation of the printing paper P, the movable blade 13 is then moved upward from the position illustrated in FIGS. 12A to 12C so as to move away from the fixed blade 12, in order to return to the initial position before the cutting operation is started. When the movable blade 13 reaches a predetermined second position above the first position, as illustrated in FIGS. 13A and 13B, the arm 2020 of the pressing member 202 comes into contact with the lower end of the second restricting part 2032 on the discharge side of the movable blade 13. Pivotal movement of the arm 2020 in the first direction $D_1$ is restricted by the second restricting part 2032.

When the movable blade 13 is moved further upward from the position illustrated in FIGS. 13A and 13B, the arm 2020 tends to pivotally move in a second direction $D_2$ opposite to the first direction $D_1$ around the shaft 204 by being pressed by the second restricting part 2032. However, the pivotal movement of the arm 2020 in the second direction $D_2$ is restricted, because the extension portion 2021 is engaging with the convex part 2031*c*. As illustrated in FIG. 13B, the extension portion 2021 presses the lower part of the convex part 2031*c* of the first restricting part 2031 with a force $F_3$. Upon receiving the force $F_3$, the first restricting part 2031 is gradually deformed resiliently, and the position of the convex part 2031*c* is gradually displaced toward the feed side.

When the movable blade 13 is further moved upwardly over the second position, the extension portion 2021 climbs over the convex part 2031*c*, and the engagement between the extension portion 2021 and the convex part 2031*c* is released. As a result, the arm 2020 pivotally moves in the second direction $D_2$, and the arm 2020 returns to the position illustrated in FIGS. 10A and 10B.

According to the tension mechanism 200 in this embodiment, it is possible to prevent the cut printing paper P from being pulled to the feed side by the pressing part 1021 after the printing paper P is cut. In particular, as illustrated in FIG. 12C, the pressing part 1021 of the second embodiment is released from the printing paper P after the printing paper P is cut but before the movable blade 13 moves upward. In other words, a force of pressing the printing paper P against the receiving member 101 is released. The movable blade 13 moves upward while the pressing force against the printing paper P is released. Therefore, according to the embodiment, the pressing part 1021 will not move toward the feed side with holding the printing paper P between the pressing part 1021 and the receiving member 101 while the movable blade 13 is moving upward. This makes it possible to prevent the cut printing paper P from returning to the feed side, and to prevent obstruction of a feeding operation of printing paper P by the returned printing paper P in a subsequent cutting operation of printing paper P.

Further, it is possible to prevent the cut printing paper P from returning according to the embodiment by selectively allowing pivotal movement of the arm 2020 in the first direction $D_1$ or in the second direction $D_2$ utilizing resilient deformation of the first restricting part 2031. This is advantageous in preventing the printing paper P from returning without the need of a complicated device.

A configuration of a tension mechanism 300 according to a third embodiment of the invention is described referring to FIGS. 14A and 14B, and FIGS. 15A and 15B. Substantially the same elements as those in the first and second embodiments are indicated with the same numerals, and a detailed description thereof is omitted herein.

The tension mechanism 300 is provided with the receiving member 101; the pressing member 202 pivotally attached to the movable blade 13; and a torsion spring 303 disposed between the movable blade 13 and the arm 2020 of the pressing member 202. The pressing member 202 is pivotally supported on the movable blade 13 via the shaft 204 inserted in the holding part 2022.

Figure 15A:
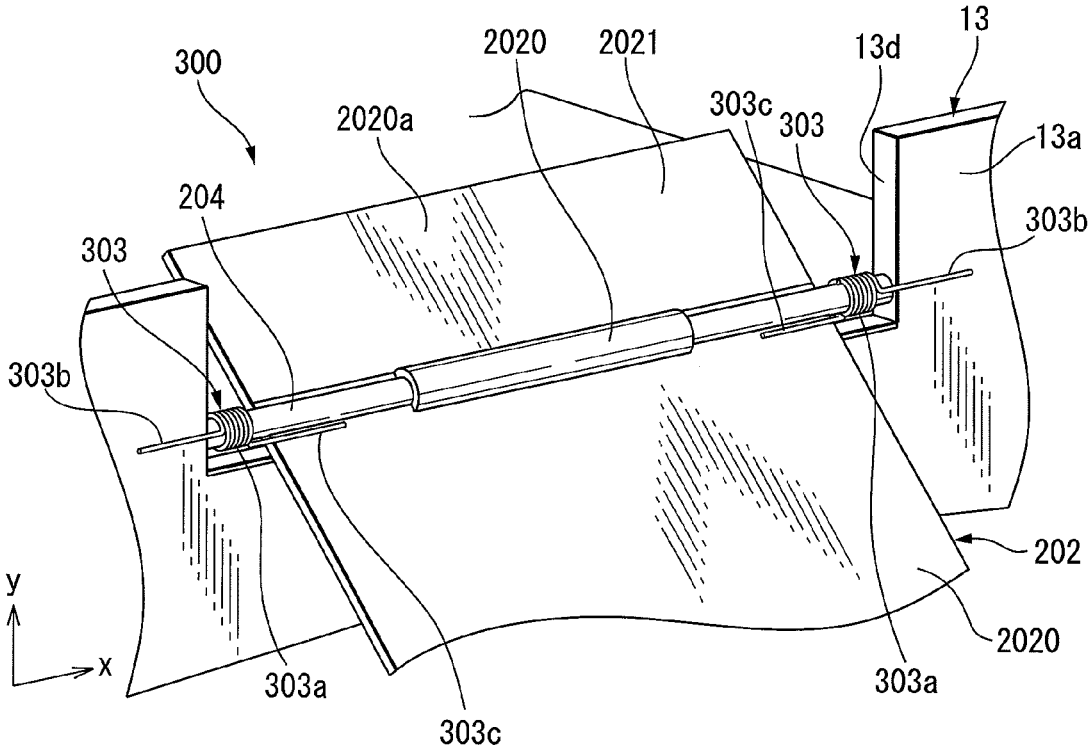
FIGS. 15A and 15B are diagrams for describing the tension mechanism.
Figure 15B:
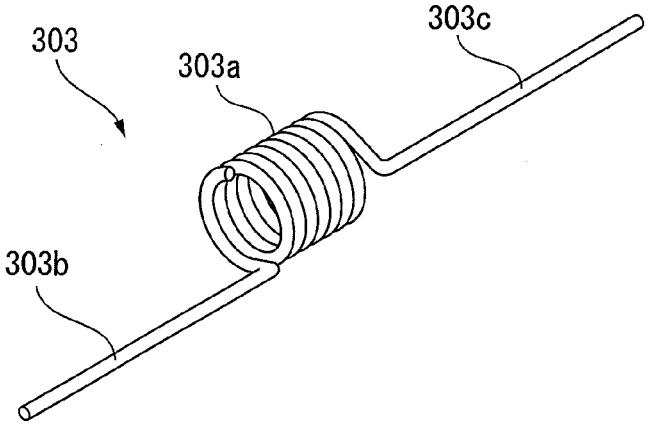
Figure 16A:
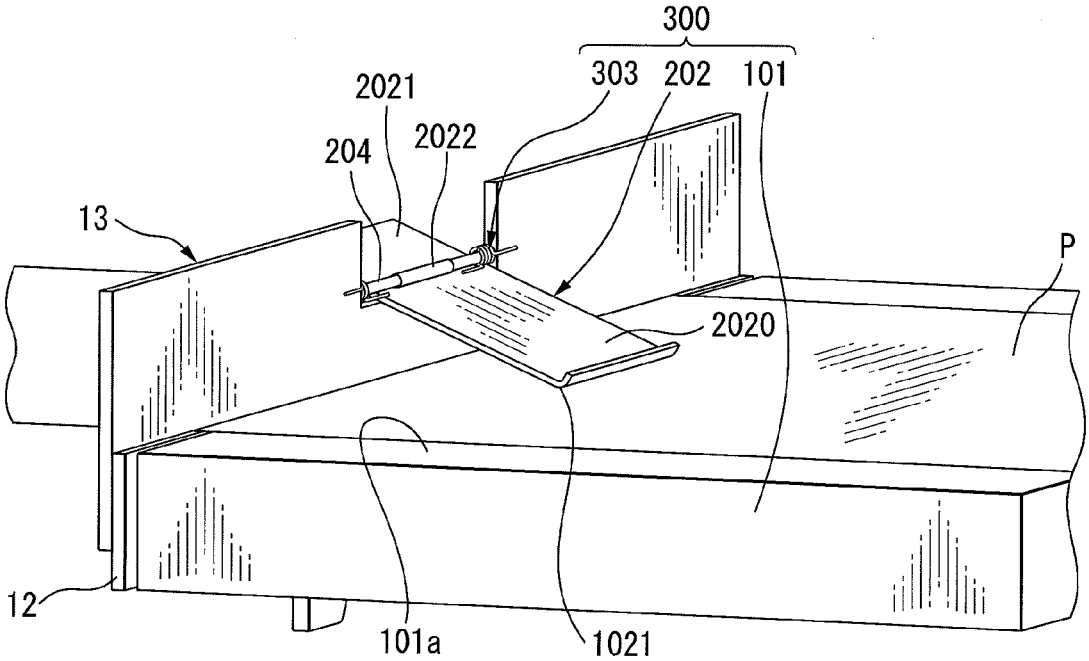
FIGS. 16A and 16B are diagrams illustrating a state that the movable blade is moved toward the fixed blade.
Figure 16B:
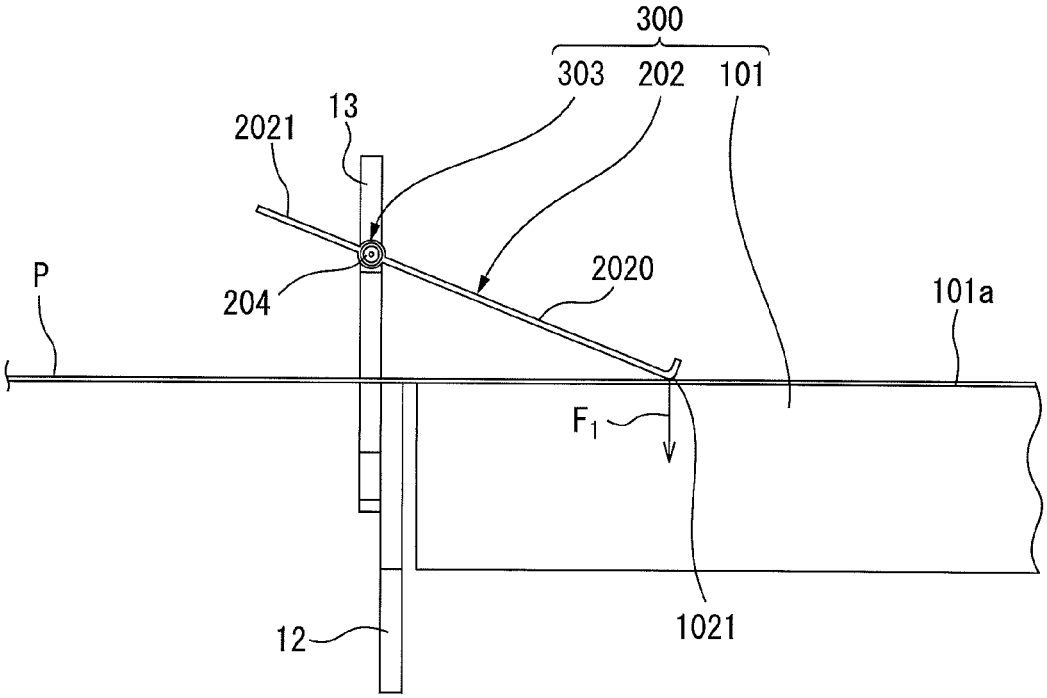

As illustrated in FIG. 15B, the torsion spring 303 includes a main body 303*a*, an end part 303*b* extending from the main body 303*a* in one direction, and an end part 303*c* extending from the main body 303*a* in the other direction. In the embodiment, two torsion springs 303 are disposed on left and right ends of the pressing member 202.

As illustrated in FIG. 15A, the first torsion spring 303 is disposed between the left edge of the arm 2020 and a left wall surface defining an opening 13*d* of the movable blade 13. The left end of the shaft 204 is inserted to the main body 303*a* of the first torsion spring 303. One end part 303*b* of the first torsion spring 303 engages the surface 13*a* of the movable blade 13 on the discharge side, while the other end part 303*c* of the first torsion spring 303 engages the arm 2020.

Similarly, the second torsion spring 303 is disposed between the right edge of the arm 2020 and the right wall surface defining the opening 13*d* of the movable blade 13. The right end of the shaft 204 is inserted to the main body 303*a* of the second torsion spring 303. One end part 303*b* of the second torsion spring 303 engages the surface 13*a* of the movable blade 13 on the discharge side, while the other end part 303*c* of the second torsion spring 303 engages the arm 2020.

Next, a function of the tension mechanism 300 in the embodiment is described referring to FIG. 14A to FIG. 17B. As the movable blade 13 moves downward toward a fixed blade 12 from the position illustrated in FIGS. 14A and 14B so as to cut the printing paper P, the pressing part 1021 moves toward the discharge side while pressing the printing paper P against the upper surface 101*a* of the receiving member 101.

During this operation, the pressing part 1021 receives, from the receiving member 101, a force in a direction opposite to the direction of force of pressing the printing paper P against the receiving member 101. Due to this force, the arm 2020 pivotally moves relative to the movable blade 13 in the first direction $D_1$ around the shaft 204 in association with downward movement of the movable blade 13, and is brought to the state illustrated in FIGS. 16A and 16B.

Figure 17A:
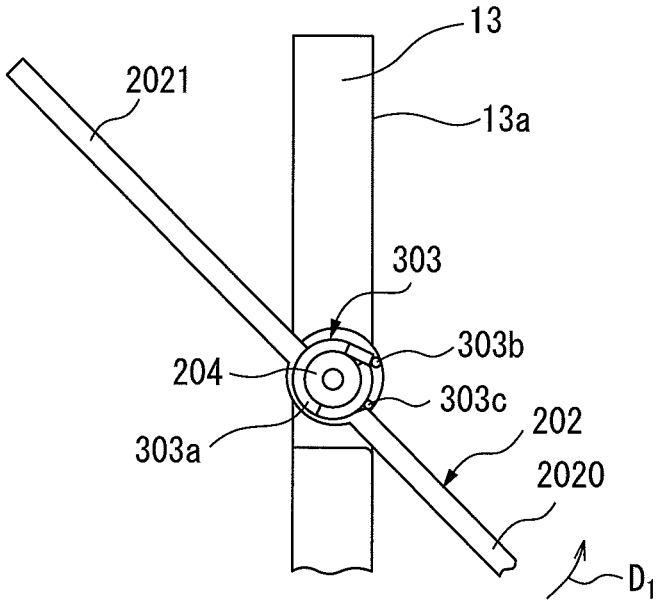
FIGS. 17A and 17B are diagrams for describing an operation of the tension mechanism.
Figure 17B:
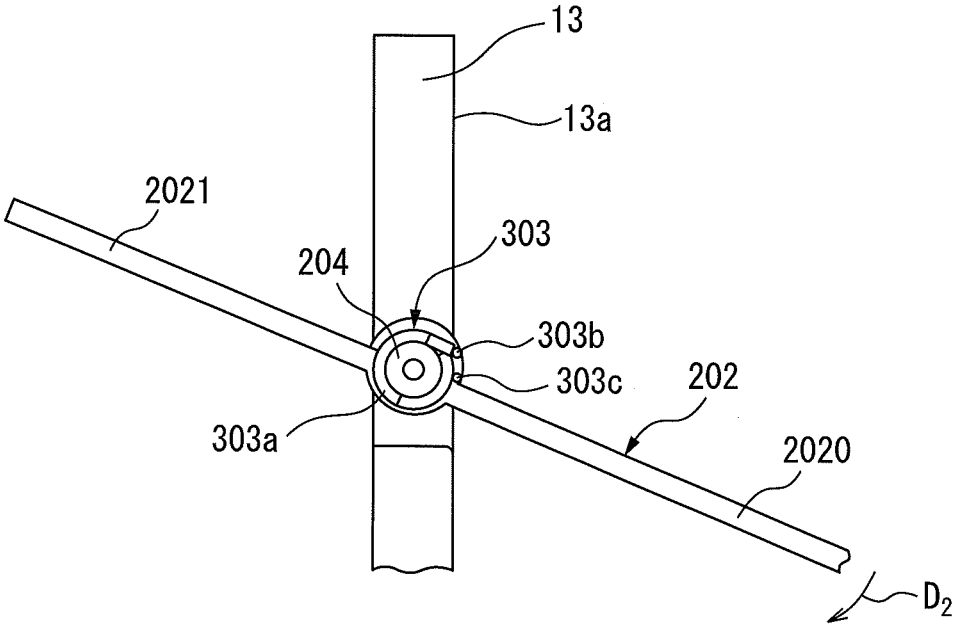
Figure 18A:
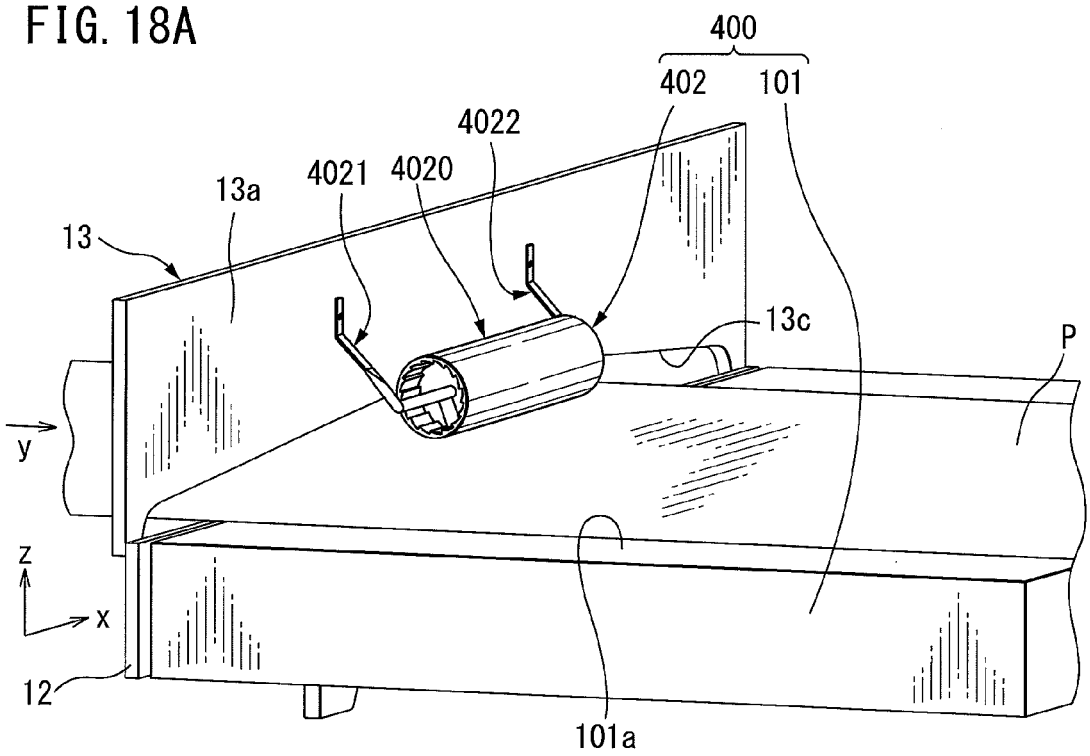
FIGS. 18A and 18B are schematic diagrams of a tension mechanism according to another embodiment of the invention.
Figure 18B:
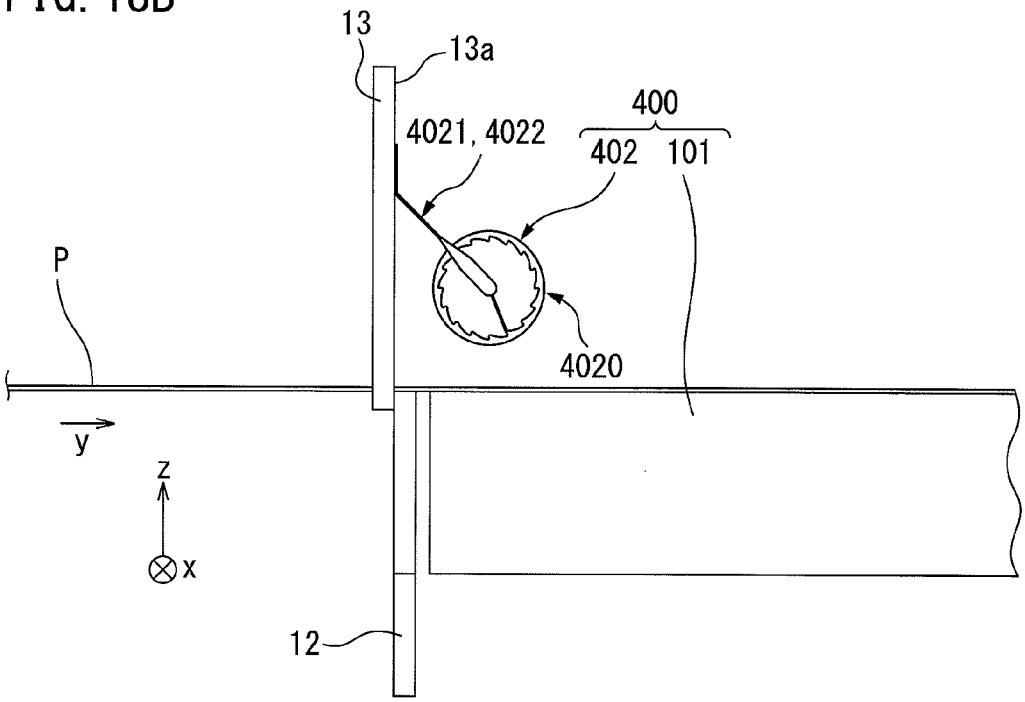

As the arm 2020 pivotally moves in the first direction $D_1$, the torsion springs 303 disposed between the movable blade 13 and the arm 2020 urge the arm 2020 in the second direction $D_2$ opposite to the first direction $D_1$. As illustrated in FIGS. 17A and 17B, when the arm 2020 is pivotally moving from the position illustrated in FIG. 17A to the position illustrated in FIG. 17B in association with downward movement of the movable blade 13, the torsion springs 303 resiliently deform in response to pivotal movement of the arm 2020.

As illustrated in FIG. 17B, the torsion springs 303 generate a resilient restoring force in the second direction $D_2$ in response to resilient deformation of the arm 2020, and urge the arm 2020 in the second direction $D_2$ by the generated resilient restoring force. By the urging force applied from the torsion springs 303 to the arm 2020, the pressing part 2021 presses the printing paper P against the upper surface 101*a* of the receiving member 101. As the movable blade 13 moves toward the fixed blade 12, the pressing part 1021 moves toward the discharge side, while holding the printing paper P between the pressing part 1021 and the receiving member 101.

By the above operation, the tension mechanism 300 in the embodiment can pull the printing paper P toward the discharge side, while holding the printing paper P between the receiving member 101 and the pressing member 202 when cutting the printing paper P. Thereby, it is possible to cut the printing paper P by the movable blade 13 and the fixed blade 12 in a state where the printing paper P is strained. This is advantageous in enhancing the cutting efficiency of printing paper P.

In addition, according to the embodiment, it is possible to press the pressing part 1021 against the upper surface 101*a* of the receiving member 101 so as to hold the printing paper P therebetween by utilizing a resilient restoring force of the torsion springs 303, without using a complicated device. This is advantageous in enhancing the cutting efficiency of printing paper P with saving the production cost.

A configuration of a tension mechanism 400 according to a fourth embodiment of the invention is described referring to FIGS. 18A and 18B, and FIGS. 19A and 19B. Substantially the same elements as those in the first to third embodiments are indicated with the same numerals, and a detailed description thereof is omitted herein. The tension mechanism 400 of the fourth embodiment is provided with a receiving member 101 and a pressing member 402.

Figure 19A:
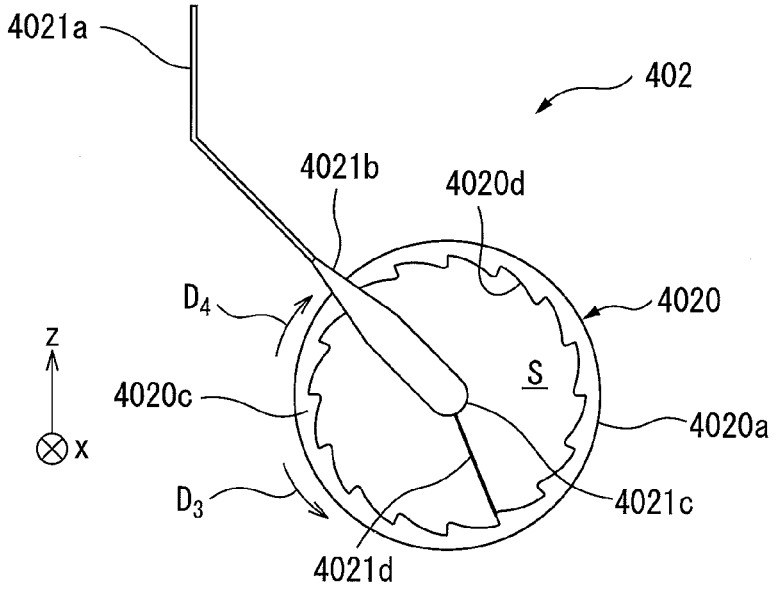
FIGS. 19A and 19B are enlarged views of a pressing member.
Figure 19B:
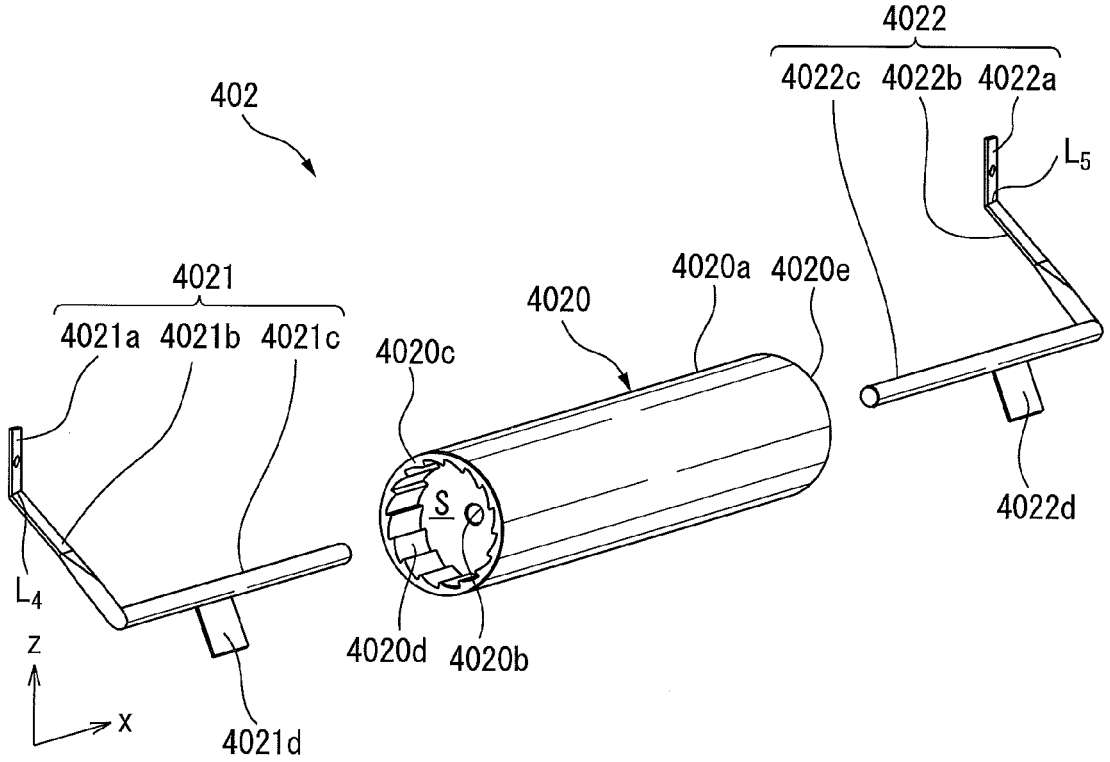

The pressing member 402 has a roller 4020, and a first arm 4021 and a second arm 4022 rotatably supports the roller 4020 at the left and right sides of the roller 4020. As illustrated in FIGS. 19A and 19B, the roller 4020 is in a cylindrical shape with a cylindrical outer peripheral surface 4020*a*, and has a center hole 4020*b* extending through the roller 4020 along the left-and-right direction (i.e. x-axis direction).

The roller 4020 has a void S recessed in the right direction from a left end surface 4020*c*. A concave-convex part 4020*d* is formed on the inner surface of the roller 4020 defining the void S. Likewise, the roller 4020 has a void (not illustrated) recessed in the left direction from a right end surface 4020*e*, and a concave-convex part (not illustrated) having substantially the same shape as the concave-convex part 4020*d* is formed on the inner surface of the roller 4020 defining the void.

The first arm 4021 is disposed on the left side of the roller 4020. The first arm 4021 has a first part 4021*a* fixed on the surface 13*a* of the movable blade 13 on the discharge side, a second part 4021*b* extending from the lower end of the first part 4021*a* toward the discharge side and toward the lower side, and a shaft 4021*c* extending from a tip of the second part 4021*b* toward the right direction.

The right end of the shaft 4021*c* is rotatably inserted in the center hole 4020*b*. A claw 4021*d* projecting from the shaft 4021*c* in one direction is formed on the shaft 4021*c*. The first part 4021*a* and the second part 4021*b* are defined by bending one resilient rod member along a bending line $L_4$.

The second arm 4022 is disposed on the right side of the roller 4020. As well as the first arm 4021, the second arm 4022 has a first part 4022*a* fixed on the surface 13*a* of the movable blade 13 on the discharge side, a second part 4022*b* extending from the lower end of the first part 4022*a* toward the discharge side and toward the lower side, and a shaft 4022*c* extending from a tip of the second part 4022*b* toward the left direction.

The left end of the shaft 4022*c* is rotatably inserted in the center hole 4020*b*. Further, a claw 4022*d* is formed on the shaft 4022*c*. The first part 4022*a* and the second part 4022*b* are defined by bending one resilient rod member along a bending line $L_5$.

As illustrated in FIG. 19A, in a state where the pressing member 402 is assembled, the concave-convex part 4020*d* formed on the left end of the roller 4020 and the claw 4021*d* formed on the first arm 4021 come into contact with each other. The concave-convex part 4020*d* and the claw 4021*d* are configured to allow the roller 4020 to rotate without engaging each other when the roller 4020 is rotated in the direction $D_3$ around the shaft parts 4021*c* and 4022*c*.

On the other hand, when the roller 4020 is rotated in a direction $D_4$ opposite to the direction $D_3$ around the shaft 4021*c* and 4022*c*, the concave-convex part 4020*d* and the claw 4021*d* engage each other, and the rotation of the roller 4020 in the direction $D_4$ is restricted. The claw 4021*d* and the concave-convex part 4020*d* constitute a one-way clutch configured to allow the roller 4020 to rotate only in the direction $D_3$.

Likewise, the concave-convex part formed on the right end of the roller 4020, and the claw 4022*d* formed on the second arm 4022 also constitute a one-way clutch configured to allow the roller 4020 to rotate only in the direction $D_3$. The functions of the one-way clutch will be described later.

Next, a function of the tension mechanism 400 in the embodiment is described referring to FIG. 18A to 21B. When the movable blade 13 moves from the position illustrated in FIGS. 18A and 18B to the position illustrated in FIGS. 20A and 20B so as to cut the printing paper P, the roller 4020 comes into contact with the printing paper P. When the movable blade 13 moves further downward from the position illustrated in FIGS. 20A and 20B to the position illustrated in FIGS. 21A and 21B, the roller 4020 is moved toward the discharge side, while pressing the printing paper P against the upper surface 101*a* of the receiving member 101 in association with movement of the movable blade 13.

During this operation, the roller 4020 tries to move toward the discharge side with rotating in the direction $D_4$. However, according to the embodiment, rotation of the roller 4020 in the direction $D_4$ is restricted by a one-way clutch constituted of the convex part 4021*d* (4022*d*) and the concave-convex part 4020*d*. Therefore, the roller 4020 moves toward the discharge side in association with downward movement of the movable blade 13 in a state where rotation of the roller 4020 is restricted. Thereby, when the roller 4020 is moving toward the discharge side, a frictional force is generated between the roller 4020 and the printing paper P. This allows the roller 4020 to effectively press the printing paper P against the receiving member 101.

As the roller 4020 moves toward the discharge side, the first arm 4021 and the second arm 4022 are bent along the bending lines $L_4$ and $L_5$ in such a manner as to decrease the angle between the first part 4021*a* (4022*a*) and the arm 4021*b* (4022*b*), and also the arms 4021*b* and 4022*b* are resiliently deformed.

The first arm 4021 and the second arm 4022 are resiliently deformed in association with downward movement of the movable blade 13 after the roller 4020 comes into contact with the printing paper P, whereby the roller 4020 is pressed against the printing paper P. Thus, the first arm 4021 and the second arm 4022 function as a plate spring capable of generating a resilient force by being resiliently deformed in response to downward movement of the movable blade 13.

Figure 20A:
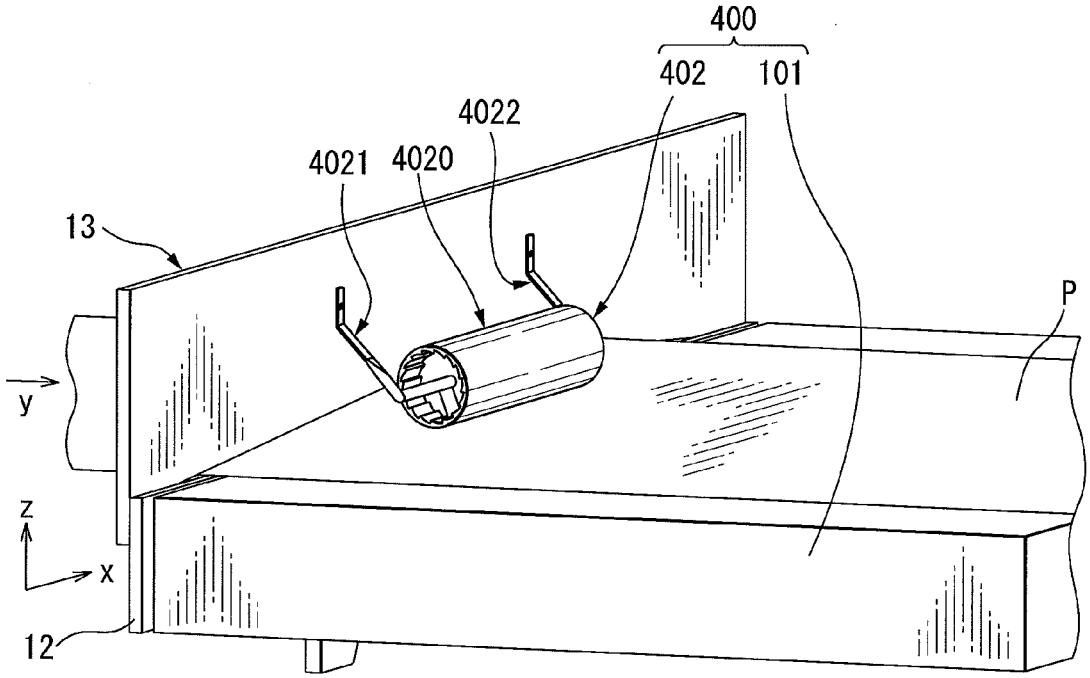
FIGS. 20A and 20B are diagrams illustrating a state that the movable blade is moved toward the fixed blade.
Figure 20B:
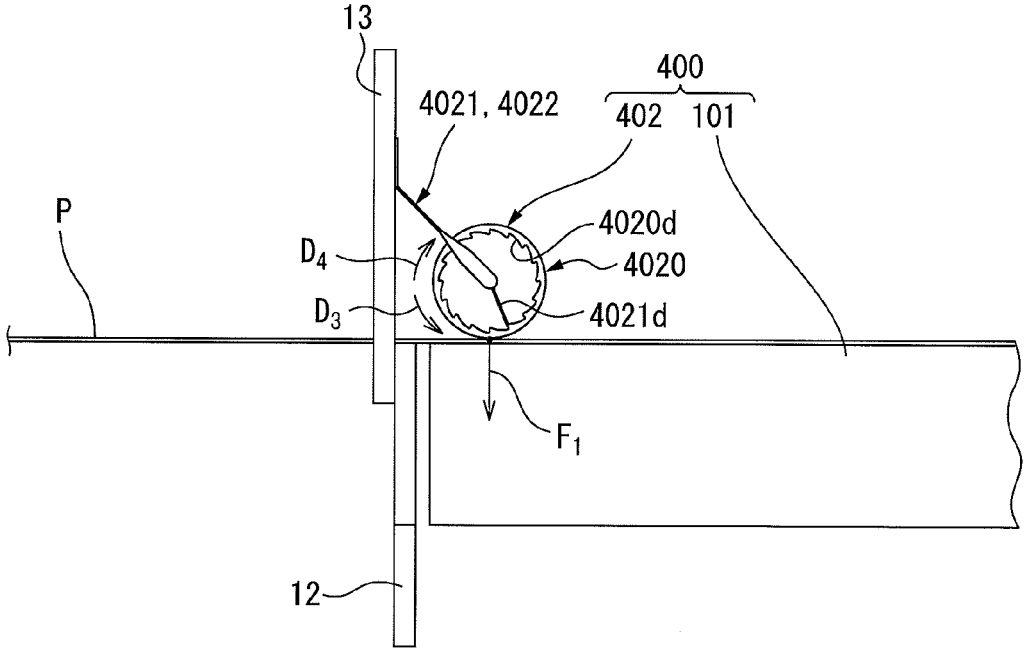
Figure 21A:
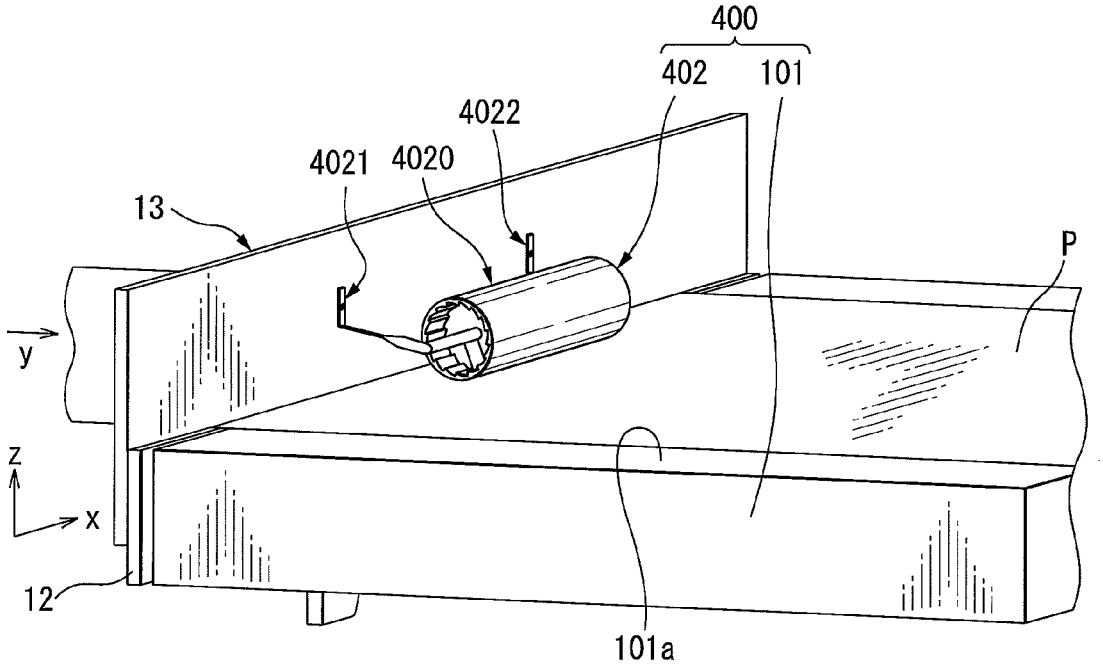
FIGS. 21A and 21B are diagrams illustrating a state that the movable blade is moved toward the fixed blade.
Figure 21B:
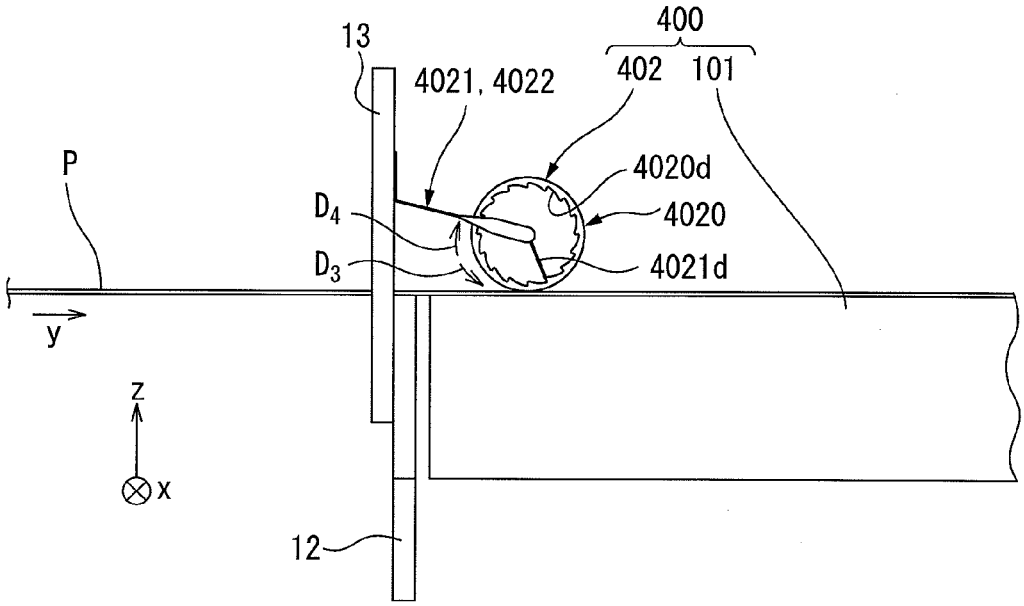

As a result, the roller 4020 moves toward the discharge side while pressing the printing paper P against the receiving member 101 with the pressing force $F_1$ which is a force component acting in a direction perpendicular to the upper surface 101*a* of the receiving member 101, as illustrated in FIGS. 20A and 20B. Thus, in this embodiment, the roller 4020 functions as a pressing part configured to press the printing paper P against the receiving member 101.

By the above operation, the tension mechanism 400 in the embodiment holds the printing paper P between the receiving member 101 and the pressing member 402 and pulls the printing paper P toward the discharge side when cutting the printing paper P. Therefore, it is possible to cut the printing paper P by the movable blade 13 and the fixed blade 12 in a state in which the printing paper P is strained. This is advantageous in enhancing the cutting efficiency of printing paper P.

In addition, according to the embodiment, providing the one-way clutch as described above makes it possible to prevent the cut printing paper P from returning toward the feed side. This operation is described in the following. After finishing the cutting operation of the printing paper P, the movable blade 13 is moved upward away from the fixed blade 12 from the position illustrated in FIGS. 21A and 21B to the position illustrated in FIGS. 18A and 18B so as to return to the initial position before the cutting operation is started.

As the movable blade 13 moves upward, the roller 4020 in contact with the upper surface 101*a* via the printing paper P tries to move toward the feed side with rotating in the direction $D_3$. The one-way clutch allows the roller 4020 to rotate in the direction $D_3$. Therefore, there is no likelihood that a frictional force is generated between the roller 4020 and the printing paper P, since the roller 4020 can rotate in the direction $D_3$ when the roller 4020 is moving toward the feed side. This makes it possible to prevent the printing paper P from returning toward the feed side while the movable blade 13 is moved upward.

Figure 22A:
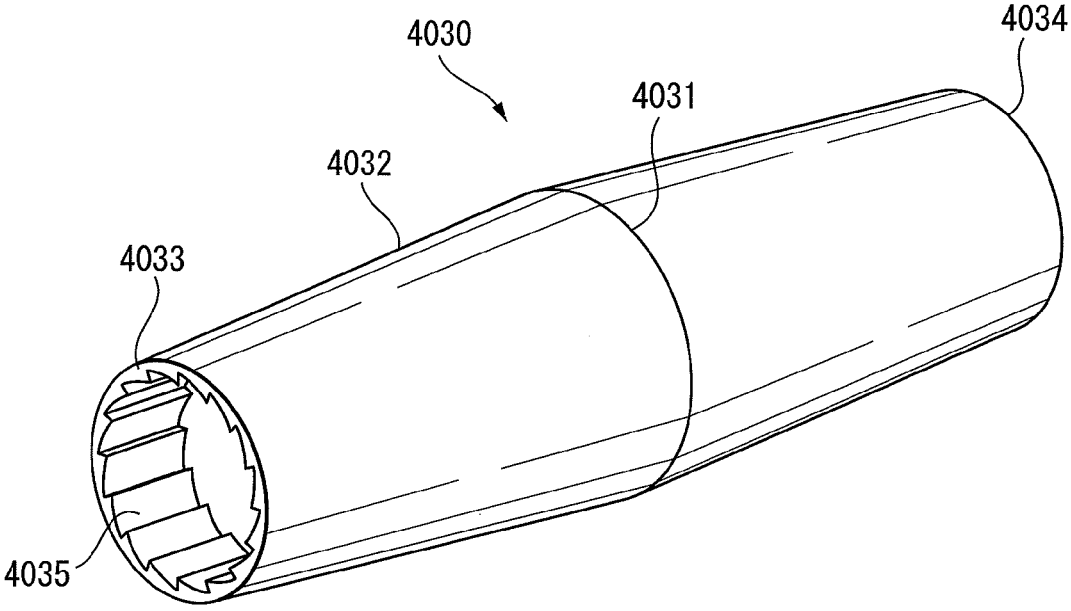
FIGS. 22A and 22B are perspective views of roller according to another embodiment of the invention.

Various shapes are applicable to the roller 4020. Rollers in other embodiments are described referring to FIGS. 22A and 22B. A roller 4030 illustrated in FIG. 22A is formed such that a middle part 4031 of the roller 4030 has a larger diameter than the diameter of left and right ends thereof. The diameter of an outer peripheral surface 4032 of the roller 4030 gradually increases, as the roller 4030 extends from a left end surface 4033 toward the middle part 4031; and gradually decreases, as the roller 4030 extends from the middle part 4031 toward a right end surface 4034. As well as the roller 4020, a concave-convex part 4035 is formed on the inner side of the left end of the roller 4030. Likewise, a concave-convex part (not illustrated) is formed on the inner side of the right end of the roller 4030.

The roller 4030 illustrated in FIG. 22A can locally press the printing paper P against the receiving member 101 in a smaller region, because the roller 4030 comes into contact with the printing paper P at the middle part 4031. This is advantageous in preventing formation of creases or wrinkles on the printing paper P when the printing paper P is pulled toward the discharge side by the roller 4030. Further, it is possible to prevent leftward oblique movement or rightward oblique movement of the roller 4030 relative to the printing paper P while the roller 4030 is moved relative to the printing paper P toward the discharge side.

Figure 22B:
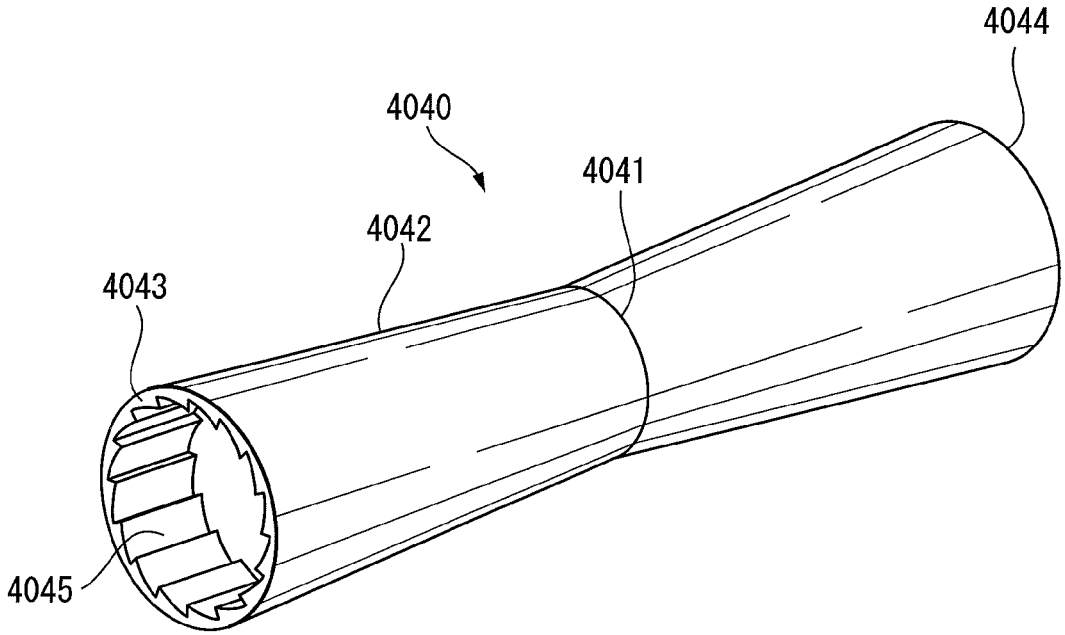

A roller 4040 illustrated in FIG. 22B is formed such that a middle part 4041 of the roller 4040 has a smaller diameter than the diameter of left and right ends thereof. The diameter of an outer peripheral surface 4042 of the roller 4040 gradually decreases, as the roller 4040 extends from a left end surface 4043 toward the middle part 4041; and gradually increases, as the roller 4040 extends from the middle part 4041 toward a right end surface 4044. Further, a concave-convex part 4045 is formed on the inner side of the left end of the roller 4040. Likewise, a concave-convex part (not illustrated) is formed on the inner side of the right end of the roller 4040.

The roller 4040 illustrated in FIG. 22B comes into contact with the printing paper P at left and right ends thereof. The roller 4040 can also locally press the printing paper P against the receiving member 101 in a smaller region, thereby it is possible to prevent formation of creases or wrinkles on the printing paper P. Further, it is also possible to prevent leftward oblique movement or rightward oblique movement of the roller 4040 relative to the printing paper P while the roller 4040 is moved relative to the printing paper P toward the discharge side.

Figure 23A:
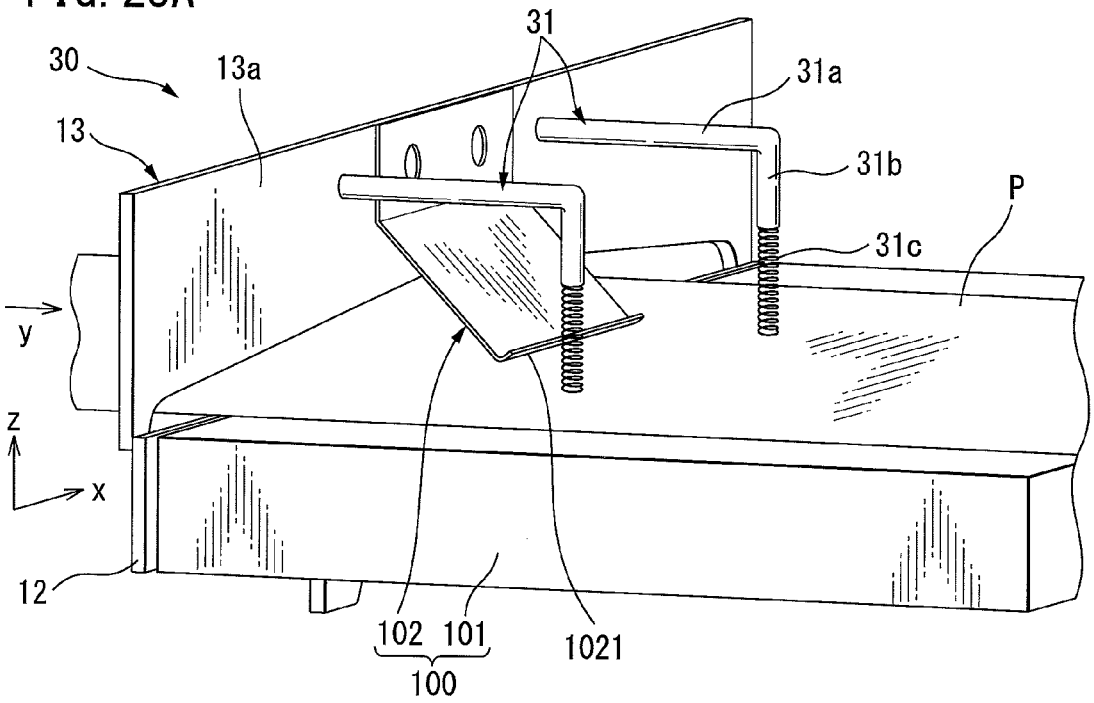
FIGS. 23A and 23B are schematic diagrams of a printer according to another embodiment of the invention.
Figure 23B:
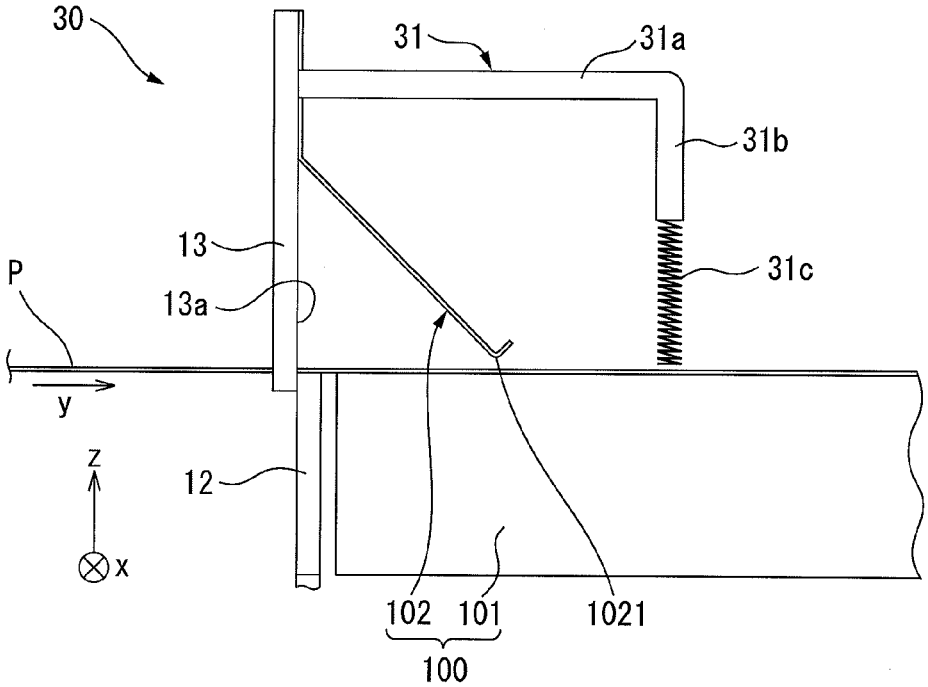

Next, a configuration of a printer 30 in a fifth embodiment of the invention is described referring to FIGS. 23A and 23B. Substantially the same elements as those in the first to fourth embodiments are indicated with the same numerals, and a detailed description thereof is omitted herein. The printer 30 is provided with a fixed blade 12; a movable blade 13; a tension mechanism 100 including a receiving member 101 and a pressing member 102; and a printing paper suppressing member 31 disposed on the discharge side of the movable blade 13.

In this embodiment, two printing paper suppressing members 31 are disposed on left and right ends of the pressing member 102. The printing paper suppressing member 31 has a first arm 31*a* fixed on a surface 13*a* of the movable blade 13 on the discharge side, a second arm 31*b* extending downward from a tip of the first arm 31*a* on the discharge side, and a spring 31*c* mounted on the lower end of the second arm 31*b* and configured to be resiliently deformable in up-and-down directions (i.e. z-axis direction).

The first arm 31*a* and the second arm 31*b* are made of a rigid material such as iron. The first arm 31*a* extends from the surface 13*a* of the movable blade 13 on the discharge side toward the discharge side. As illustrated in FIGS. 23A and 23B, the spring 31*c* is disposed such that the lower end of the spring 31*c* is located at a position below a pressing part 1021 in a state wherein both of the pressing part 1021 and the spring 31*c* do not come into contact with the printing paper P. Further, the spring 31*c* is disposed to come into contact with the top surface of the printing paper P in a direction perpendicular thereto.

Next, a function of the printing paper suppressing member 31 in the embodiment is described referring to FIGS. 23A to 26B. When the movable blade 13 is moved downward from the position illustrated in FIGS. 23A and 23B so as to cut the printing paper P, the lower end of the spring 31*c* comes into contact with the printing paper P before the pressing part 1021 comes into contact with the printing paper P, as illustrated in FIGS. 24A and 24B. As the movable blade 13 is moved downward from this position, the spring 31*c* is compressed in up-and-down directions, whereby the printing paper P is held between the spring 31*c* and the receiving member 101.

Figure 25A:
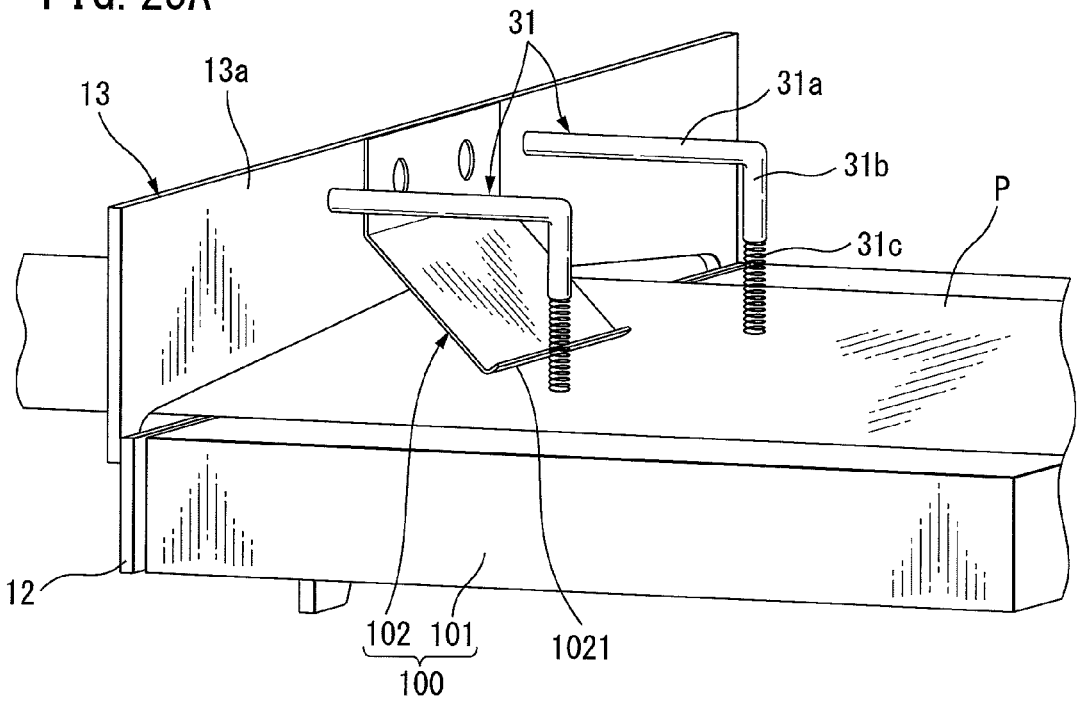
FIGS. 25A and 25B are diagrams illustrating a state that the movable blade is moved toward the fixed blade.
Figure 25B:
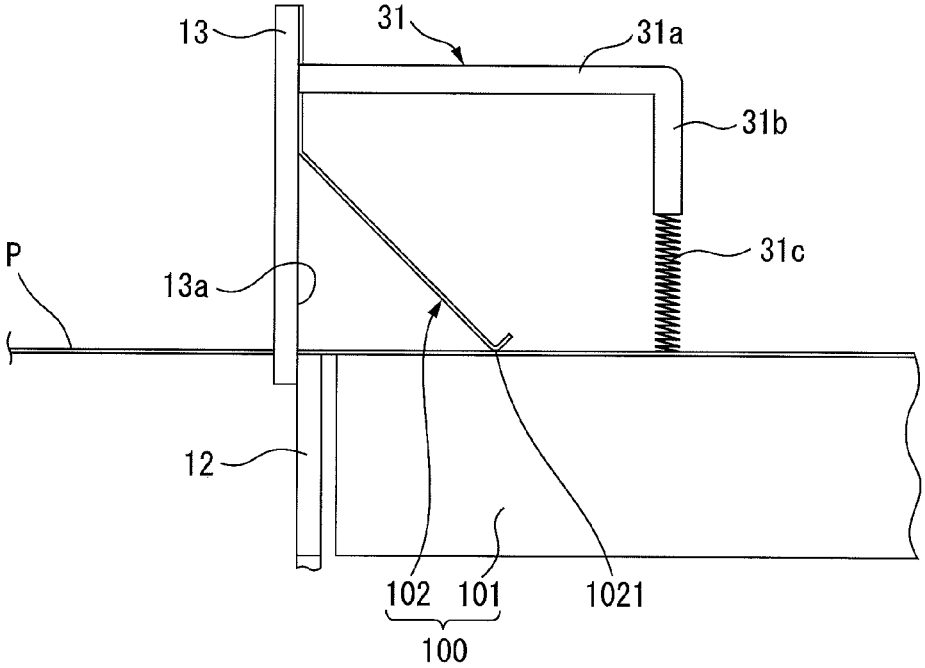

When the movable blade 13 is moved downward to the position illustrated in FIGS. 25A and 25B, the pressing part 1021 comes into contact with the printing paper P. As the movable blade 13 is moved further downward from the position illustrated in FIGS. 25A and 25B to the position illustrated in FIGS. 26A and 26B, the tension mechanism 100 pulls the printing paper P toward the discharge side, and the printing paper P is cut by the movable blade 13 and the fixed blade 12 in a state wherein the printing paper P is strained. During this operation, the printing paper suppressing member 31 holds the printing paper P between the printing paper suppressing member 31 and the receiving member 101 by the action of the spring 31*c*.

Figure 26A:
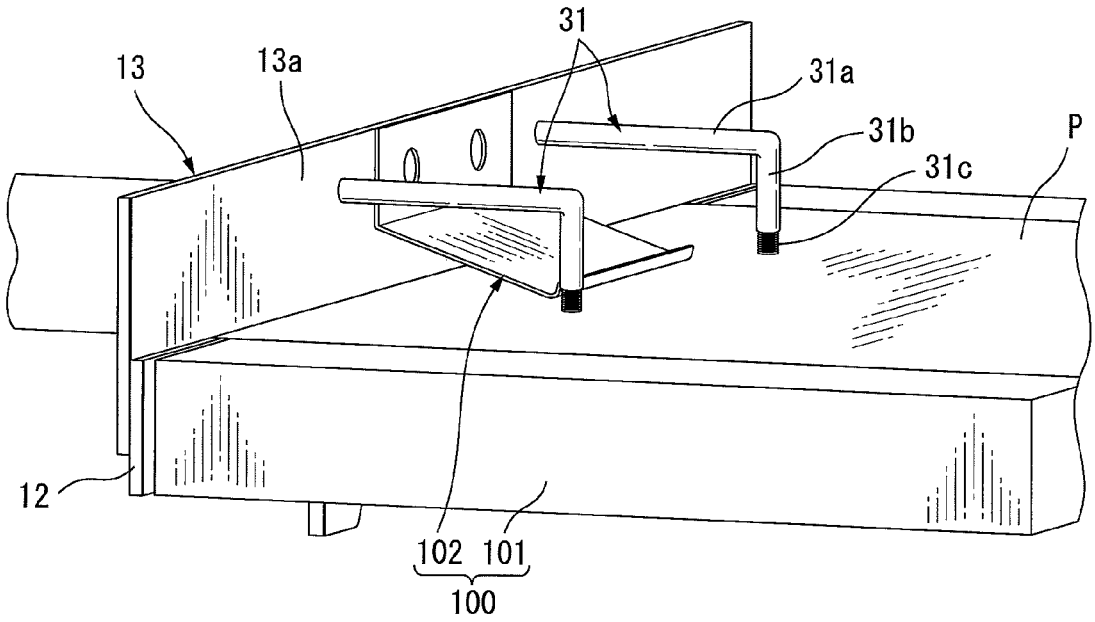
FIGS. 26A and 26B are diagrams illustrating a state that the movable blade is moved toward the fixed blade.
Figure 26B:
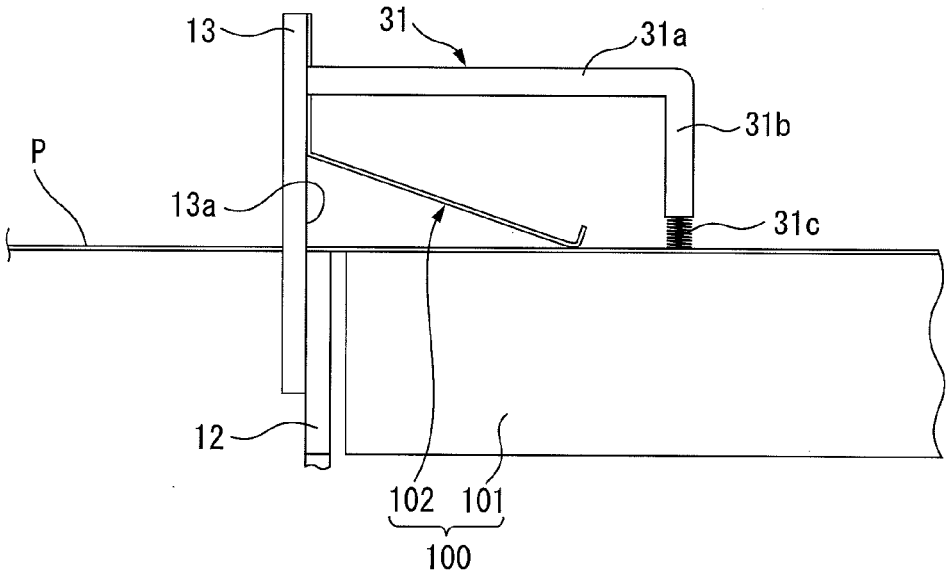

After cutting the printing paper P, the movable blade 13 is moved upward from the position illustrated in FIGS. 26A and 26B to the position illustrated in FIGS. 25A and 25B. During this operation, the pressing part 1021 is moved toward the feed side, while holding the printing paper P between the pressing part 1021 and the receiving member 101. Specifically, the tension mechanism 100 tries to pull the cut printing paper P toward the feed side during this operation.

In the embodiment, the printing paper suppressing member 31 suppresses the printing paper P while holding the printing paper P between the printing paper suppressing member 31 and the receiving member 101 by the action of the spring 31*c*. This could prevent returning of the cut printing paper P toward the feed side by the tension mechanism 100.

Figure 24A:
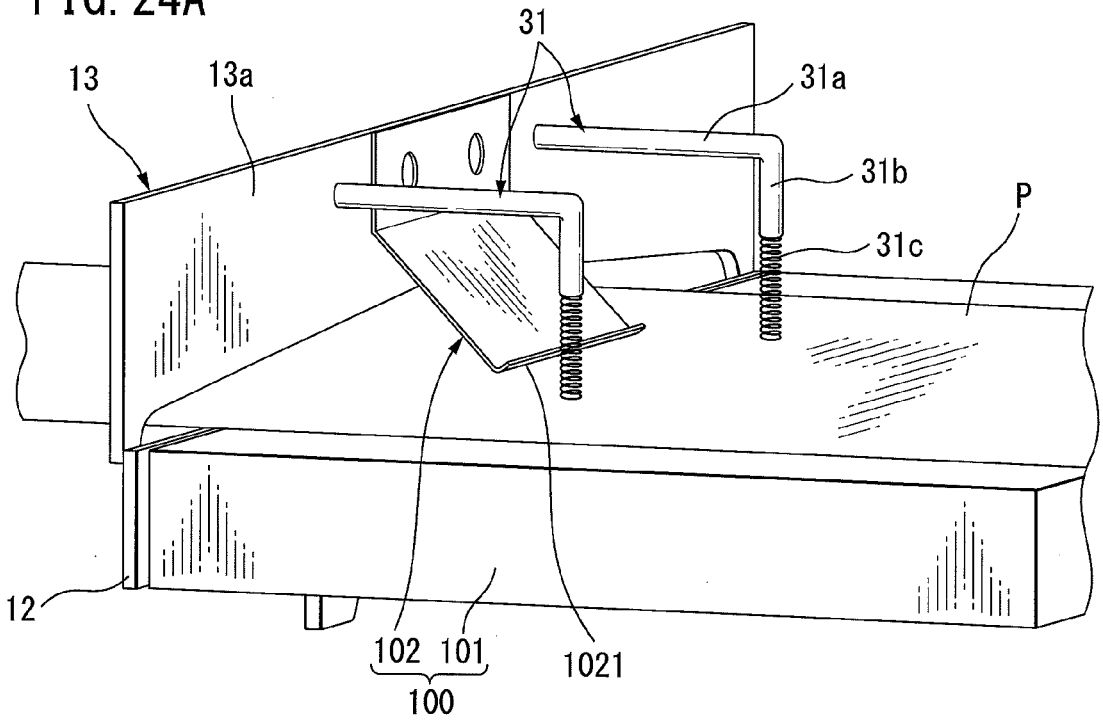
FIGS. 24A and 24B are diagrams illustrating a state that the movable blade is moved toward the fixed blade.
Figure 24B:
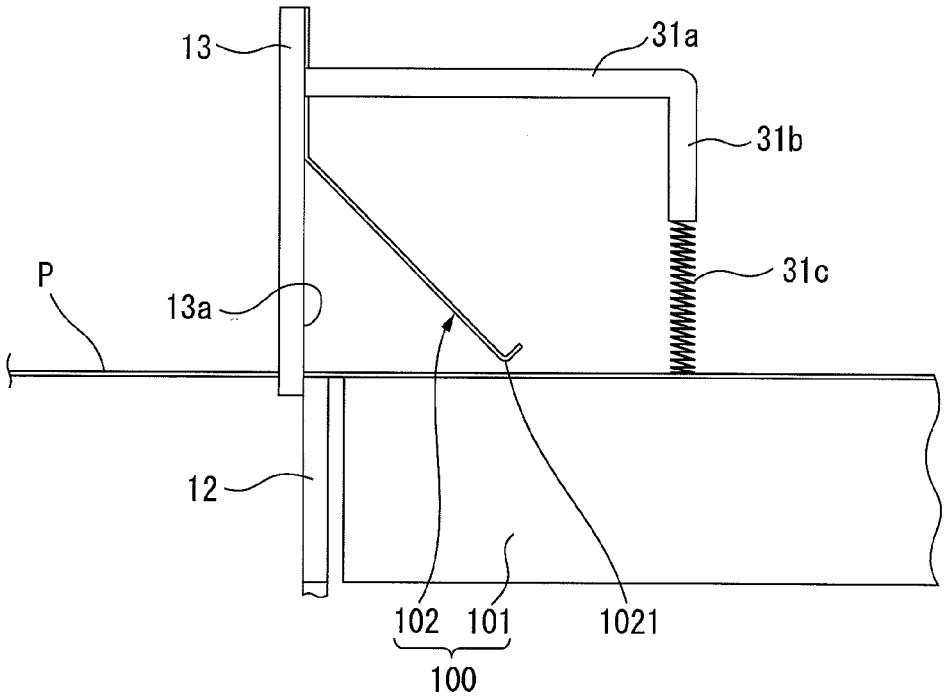

When the movable blade 13 is moved upward to the position illustrated in FIGS. 24A and 24B, the pressing part 1021 is released from the printing paper P before the spring 31*c* is released from the printing paper P. Subsequently, when the movable blade 13 is moved upward to the position illustrated in FIGS. 25A and 25B, the spring 31*c* is released from the printing paper P. In this way, the printing paper suppressing member 31 securely suppresses the printing paper P until the force of pulling the cut printing paper P toward the feed side by the tension mechanism 100 is released.

Figure 27A:
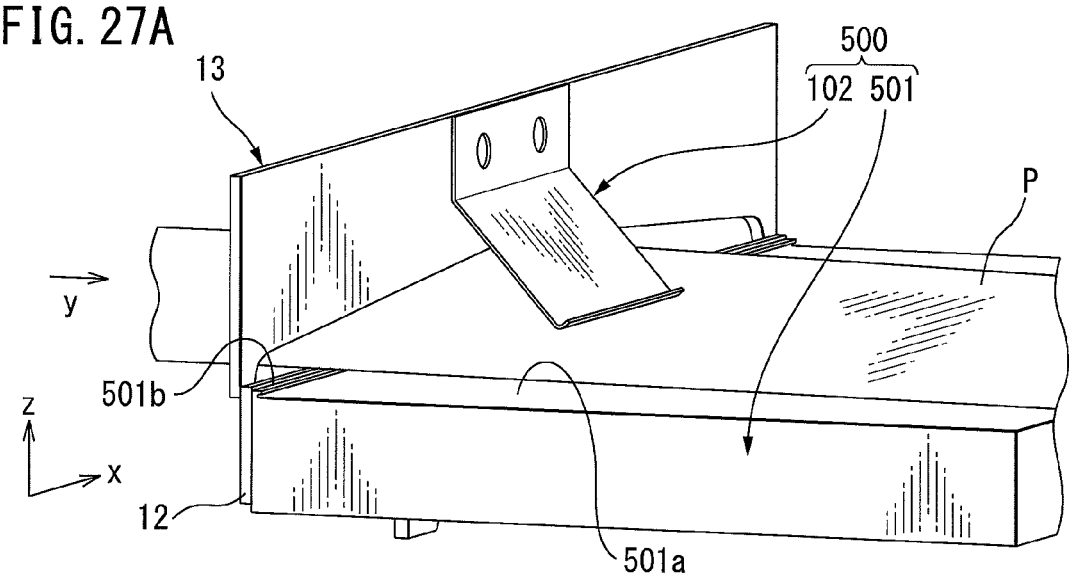
FIGS. 27A to 27C are schematic diagrams for describing a receiving member according to another embodiment of the invention.
Figure 27B:
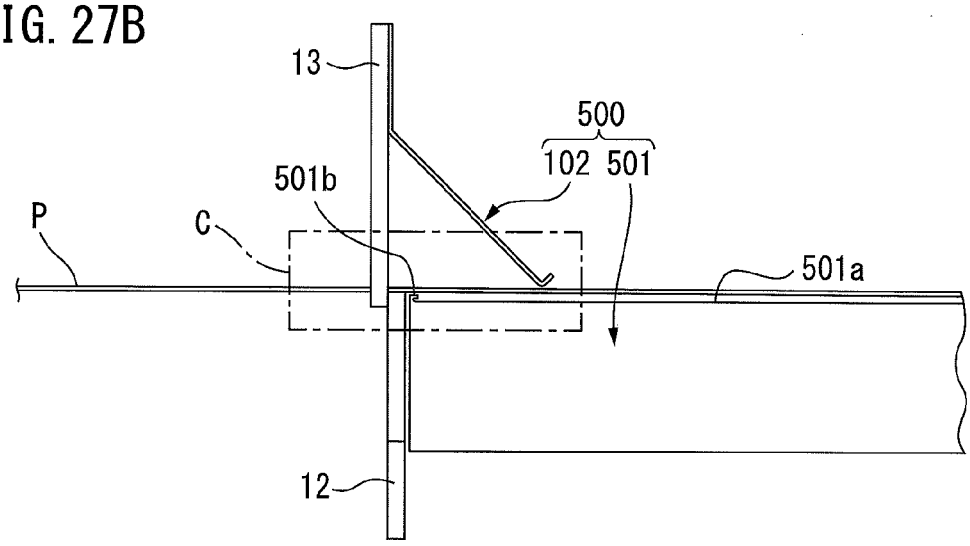
Figure 27C:
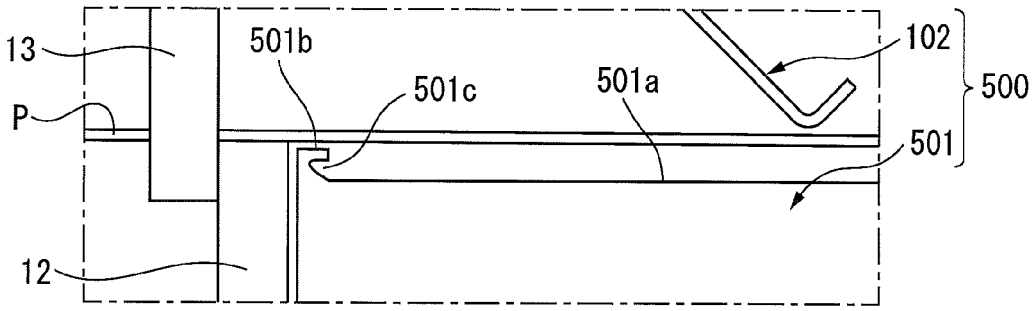

Next, a configuration of a tension mechanism 500 according to another embodiment of the invention is described referring to FIGS. 27A and 27B. Substantially the same elements as those in the first to fifth embodiments are indicated with the same numerals, and a detailed description thereof is omitted herein. The tension mechanism 500 is provided with a pressing member 102, and a receiving member 501 in the embodiment.

The receiving member 501 is disposed on the discharge side of the fixed blade 12. The receiving member 501 has, on a feed side end thereof, a convex part 501*b* projecting upward toward the printing paper P from an upper surface 501*a*. Further, a concave part 501*c* opened toward the discharge side is formed in a discharge side of the convex part 501*b*.

Next, a function of the tension mechanism 500 in the embodiment is described referring to FIGS. 27A to 27C, and FIGS. 28A to 28C. When the movable blade 13 is moved from the position illustrated in FIGS. 27A to 27C to the position illustrated in FIGS. 28A to 28C so as to cut the printing paper P, the pressing member 102 pulls the printing paper P toward the discharge side in cooperation with the receiving member 501. Then, the fixed blade 12 and the movable blade 13 cut the printing paper P.

Figure 28A:
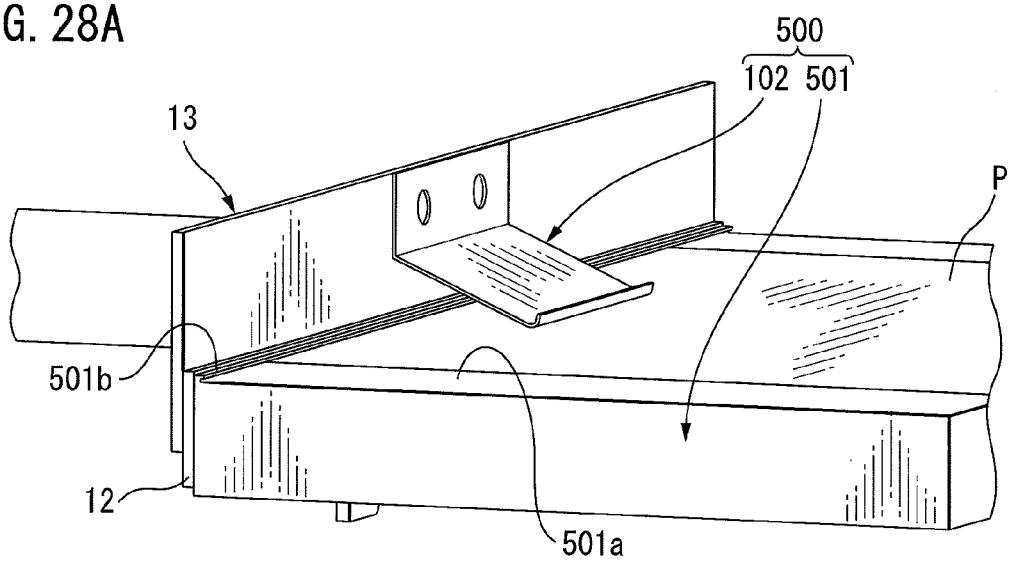
FIGS. 28A to 28C are diagrams illustrating a state after printing paper is cut.
Figure 28B:
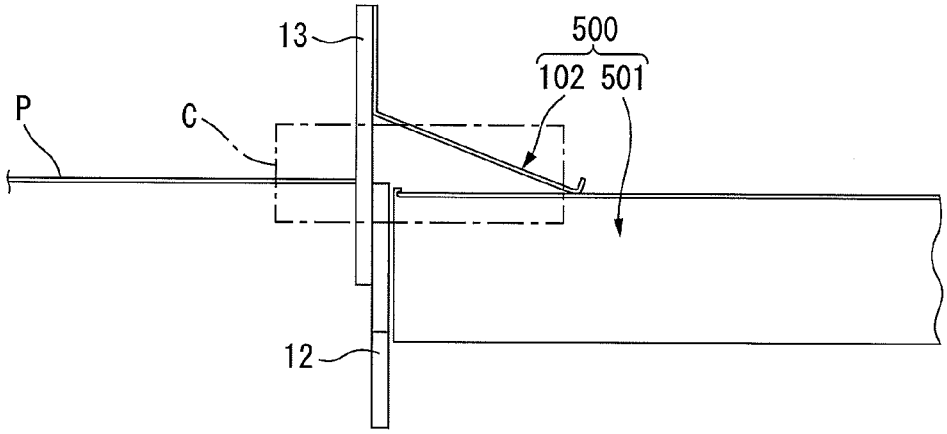
Figure 28C:
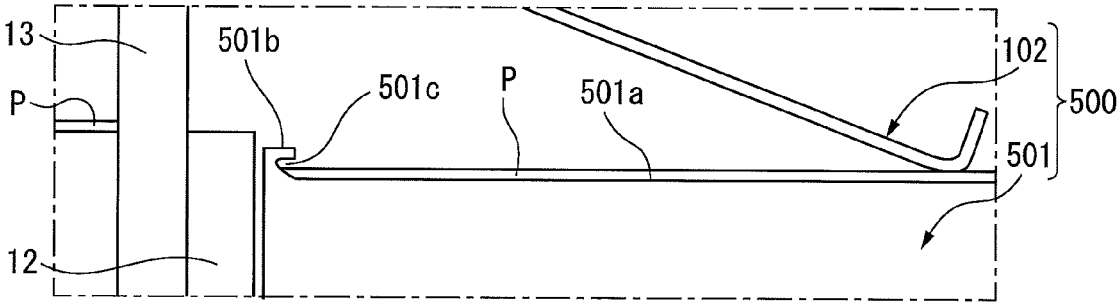

In the embodiment, the convex part 501*b* including the concave part 501*c* is formed on the feed side end of the receiving member 501. When a cutting operation is finished, an end of the cut printing paper P is accommodated in the concave part 501*c*, as illustrated in FIG. 28C. This makes it possible to prevent the cut printing paper P from moving toward the feed side.

According to the above configuration, it is possible to prevent the cut printing paper P from returning toward the feed side by the pressing member 102, as the movable blade 13 is moved upward after a cutting operation of printing paper P is finished. This is advantageous in preventing obstruction of a feeding operation of printing paper P by the cut and returned printing paper P in a succeeding cutting operation of printing paper P.

The movable blade may be disposed on the feed side or on the discharge side of the fixed blade. Further, in the foregoing embodiments, a receiving member is fixedly mounted in a housing. However, the invention is not limited to the above. A receiving member may be mounted in a housing on the feed side or on the discharge side to be reciprocally movable, and the receiving member may be configured to be moved toward the discharge side, while holding the printing paper in cooperation with a pressing part, as the movable blade is moved downward in cutting the printing paper.

Further, in the foregoing embodiments, it is exemplified that the upper surface of a receiving member is a flat surface. Alternatively, the upper surface of a receiving member may be a curved surface. For instance, the upper surface of a receiving member may be a curved surface such that the upper surface is curved upward with a predetermined curvature radius, as the receiving member extends toward the discharge side.

Further, in the foregoing embodiments, it is exemplified that a roller is mounted on a first arm and a second arm. However, the invention is not limited to the above. A roller may be replaced by the pressing part described in FIGS. 8A to 17B, and the pressing part may be mounted on the arm described in FIGS. 8A to 17B. Further, a roller may have an outer peripheral surface, for example, having a concave-convex shape, other than the shapes illustrated in FIGS. 19A and 19B, and FIGS. 22A and 22B.

The invention has been described by way of the embodiments of the invention. The foregoing embodiments, however, do not limit the invention defined in the claims. Further, it is obvious to those skilled in the art to add a variety of modifications or improvements to the embodiments. It is obvious that such modifications or improvements are also included in the technical scope of the invention, as defined in the claims of the invention.

The invention claimed is:

1. A printer for printing on a printing medium, comprising:

a printing unit;

a fixed blade;

a movable blade provided to be movable relative to the fixed blade, and configured to cut the printing medium with the fixed blade;

a receiving member disposed on a discharge side which is a direction in which the printing medium is discharged relative to the fixed blade, for receiving the printing medium; and a pressing member extending from the movable blade toward the discharge side, and configured to move with the movable blade and apply a tensional force to the printing medium, including a pressing part configured to press the printing medium against the receiving member and move in a direction away from the fixed blade while contacting the printing medium, as the movable blade moves toward the fixed blade.

2. The printer according to claim 1, wherein the pressing member includes an arm configured to resiliently deform as the movable blade moves toward the fixed blade when the pressing part comes into contact with the printing medium, wherein the arm is configured to force the pressing part to contact with the printing medium by a restoring force of the arm.

3. The printer according to claim 1, wherein the pressing member includes an arm pivotally attached to the movable blade and is configured to deform as the movable blade moves toward the fixed blade when the pressing part comes into contact with the printing medium, the printer further comprises a restricting unit configured to restrict the arm from pivoting relative to the movable blade in a first direction, wherein the restricting unit restricts the arm from pivoting in the first direction when the restricting unit engages with the arm until the pressing part presses the printing medium and the movable blade reaches a first position, and allows the arm to pivot in the first direction when the restricting unit is released from the engagement with the arm when the movable blade further moves over the first position, so that the pressing part is released from the printing medium.

4. The printer according to claim 3, wherein the arm includes an extension portion extending from the movable blade toward a feed side which is a direction the printing medium is fed from, wherein the restricting unit includes a convex part that engages with the extension portion until the movable blade reaches the first position, wherein the convex part is configured to be pressed by the extension portion and displaced while the movable blade is moving to the first position, and the extension portion climbs over the convex part and the arm moves in the first direction when the movable blade crosses over the first position.

5. The printer according to claim 4, wherein the restricting unit includes a return part configured to come into contact with the arm on the discharge side of the movable blade when the movable blade moves in a direction away from the fixed blade and reaches a second position above the first position after the arm pivotally moves in the first direction, wherein the extension portion of the arm in contact with the return part is configured to climb over the convex part while the movable blade crosses over the second position and further moves in the direction away from the fixed blade, and the arm pivotally moves in a second direction opposite to the first direction.

6. The printer according to claim 1, wherein the pressing member includes an arm pivotally attached to the movable blade, wherein the printer further comprises a spring disposed between the movable blade and the arm, the spring urging the arm in a second direction opposite to the first direction when the arm pivotally moves relative to the movable blade in a first direction by a force of pressing the printing medium against the receiving member by the pressing part.

7. The printer according to claim 1, further comprising a suppressing member disposed on the discharge side of the movable blade, wherein the suppressing member comes into contact with the printing medium and holds the printing medium between the suppressing member and the receiving member when the movable blade moves toward the fixed blade, and is released from the printing medium after the pressing part is released from the printing medium when the movable blade moves in a direction away from the fixed blade.

8. The printer according to claim 1, wherein the pressing part includes a roller configured to press the printing medium against the receiving member, and roll toward the discharge side as the movable blade moves toward the fixed blade.

9. The printer according to claim 8, wherein the pressing member further includes a one-way clutch configured to allow pivotal movement of the roller only in one direction.

10. The printer according to claim 1, wherein the receiving member includes a convex part projecting from a feed side end of the receiving member toward the printing medium.

11. A printer for printing on a printing medium, comprising:

a printing unit;

a fixed blade;

a movable blade provided to be movable relative to the fixed blade, and configured to cut the printing medium with the fixed blade;

a receiving member for receiving the printing medium, that is disposed on a downstream side relative to the fixed blade in a direction in which the printing medium is fed; and a pressing member extending from the movable blade toward the downstream side, and configured to move with the movable blade and apply a tensional force to the printing medium, the pressing member includes a pressing part configured to press the printing medium against the receiving member and pull the printing medium toward the downstream side while contacting the printing medium as the movable blade moves toward the fixed blade.

12. The printer according to claim 11, wherein the pressing member is configured to resiliently deform when the movable blade moves toward the fixed blade and the pressing part comes into contact with the printing medium.

13. The printer according to claim 11, wherein the pressing member is rotatably attached to the movable blade and is configured to rotate in a first direction when the movable blade moves toward the fixed blade while the pressing part is contacting with the printing medium, the printer further comprises a restricting unit configured to restrict the pressing member from rotating in the first direction, wherein the restricting unit contacts with the pressing member and restricts the pressing member from rotating in the first direction until the movable blade moving toward the fixed blade reaches a first position, and is released from contacting with the pressing member so as to allow the pressing member to rotate in the first direction when the movable blade further moves over the first position.

14. The printer according to claim 11, wherein the pressing member is rotatably attached to the movable blade, wherein the printer further comprises a spring disposed between the movable blade and the pressing member, the spring urging the pressing member in a second direction which is opposite to a first direction.

15. The printer according to claim 11, wherein the pressing part includes a roller configured to press the printing medium against the receiving member, and roll as the movable blade moves toward the fixed blade.

16. The printer according to claim 15, wherein the pressing member further includes a one-way clutch configured to allow pivotal movement of the roller only in one direction.

* * * * *